US007479103B2

(12) United States Patent
Ellen

(10) Patent No.: US 7,479,103 B2
(45) Date of Patent: Jan. 20, 2009

(54) PORTABLE ISOLATION ENCLOSURE

(75) Inventor: Thomas D. Ellen, North Granby, CT (US)

(73) Assignee: Vivax Medical Corporation, Torrington, CT (US)

( * ) Notice: Subject to any disclaimer, the term of this patent is extended or adjusted under 35 U.S.C. 154(b) by 255 days.

(21) Appl. No.: 11/196,654

(22) Filed: Aug. 2, 2005

(65) Prior Publication Data

US 2006/0020159 A1 Jan. 26, 2006

Related U.S. Application Data

(63) Continuation-in-part of application No. 10/910,939, filed on Aug. 3, 2004, now Pat. No. 7,380,296, which is a continuation-in-part of application No. 10/294,313, filed on Nov. 14, 2002, now Pat. No. 6,772,458.

(60) Provisional application No. 60/332,750, filed on Nov. 14, 2001.

(51) Int. Cl.
*A61G 10/00* (2006.01)

(52) U.S. Cl. ..... 600/21

(58) Field of Classification Search ..... 600/21–22; 128/202.12, 205.26; 454/187–189, 251; 55/385.2

See application file for complete search history.

(56) References Cited

U.S. PATENT DOCUMENTS

| | | | |
|---|---|---|---|
| 875,206 | A | 12/1907 | Osborne |
| 1,410,830 | A | 3/1922 | O'Neal |
| 1,526,038 | A | 2/1925 | Allman |
| 2,850,027 | A | 9/1958 | Smith |
| 3,051,164 | A | 8/1962 | Trexler |
| 3,119,358 | A | 1/1964 | Colson et al. |
| 3,265,059 | A | 8/1966 | Matthews |
| 3,272,199 | A | 9/1966 | Matthews |
| 3,345,996 | A | 10/1967 | Sadove et al. |
| 3,348,890 | A | 10/1967 | Trexler |

(Continued)

*Primary Examiner*—Charles A Marmor, II
*Assistant Examiner*—Christine D Hopkins
(74) *Attorney, Agent, or Firm*—McCarter & English, LLP

(57) ABSTRACT

An isolation enclosure is provided for isolating a person to an area about a bed, wherein the bed is adapted to support the person and includes a frame and a mattress overlying the frame. The isolation enclosure comprises a frame adapted to surround the bed; and a canopy connectable to the frame and defining an isolation chamber sealed with respect to the ambient atmosphere. The isolation chamber extends over the frame of the bed and is sufficiently large to allow a person located within the isolation chamber to be supported on the bed and to move freely within the isolation chamber. The canopy includes a base wall adapted to either (i) overly the mattress of the bed, and (ii) lie between the mattress and the frame of the bed. A frame transport device, such as wheels, casters, or sliders, is mounted on the frame and adapted to transport the frame and canopy in cooperation with the bed to thereby transport a patient supported on the bed and located within the isolation chamber. An environmental control device is connectable in fluid communication with the isolation chamber and includes (i) a filter adapted to filter air entering and filter air exiting the isolation chamber, and (ii) a pump adapted to pump air into the isolation chamber to increase the pressure within the isolation chamber relative to the ambient atmosphere, and pump air out of the isolation chamber to decrease the pressure within the isolation chamber relative to the ambient atmosphere.

23 Claims, 26 Drawing Sheets

U.S. PATENT DOCUMENTS

| | | | | |
|---|---|---|---|---|
| 3,492,987 | A | | 2/1970 | Parker |
| 3,501,213 | A | | 3/1970 | Trexler |
| 3,505,989 | A | | 4/1970 | Truhan |
| 3,601,031 | A | | 8/1971 | Abel et al. |
| 3,709,210 | A | | 1/1973 | Matthews |
| 3,802,416 | A | | 4/1974 | Cazalis |
| 3,935,803 | A | * | 2/1976 | Bush ..... 454/189 |
| 4,026,286 | A | | 5/1977 | Trexler |
| 4,335,712 | A | | 6/1982 | Trexler |
| 4,641,387 | A | | 2/1987 | Bondy et al. |
| 4,731,961 | A | | 3/1988 | Bona |
| 5,216,291 | A | | 6/1993 | Seevinck et al. |
| 5,314,377 | A | | 5/1994 | Pelosi, III |
| 5,384,925 | A | | 1/1995 | Vail |
| 5,771,651 | A | | 6/1998 | Shiina |
| 6,125,483 | A | | 10/2000 | Stroud et al. |
| 6,216,291 | B1 | | 4/2001 | Eads et al. |
| 6,263,529 | B1 | | 7/2001 | Chadwick et al. |
| 6,321,764 | B1 | | 11/2001 | Gauger et al. |
| 6,418,932 | B2 | * | 7/2002 | Paschal et al. ..... 128/845 |
| 6,425,255 | B1 | | 7/2002 | Hoffman |
| 6,461,290 | B1 | | 10/2002 | Reichman et al. |
| 6,966,937 | B2 | * | 11/2005 | Yachi et al. ..... 55/385.2 |
| 2006/0149120 | A1 | * | 7/2006 | Melles ..... 600/21 |

* cited by examiner

PORTABLE ISOLATION ENCLOSURE

CROSS REFERENCE TO RELATED APPLICATIONS

This patent application is a Continuation-In-Part (CIP) of U.S. patent application Ser. No. 10/910,939 filed Aug. 3, 2004, now U.S. Pat. No. 7,380,296 which is a Continuation-In-Part (CIP) of U.S. patent application Ser. No. 10/294,313 filed Nov. 14, 2002, now U.S. Pat. No. 6,772,458 which claims priority to U.S. Provisional Patent Application No. 60/332,750, filed Nov. 14, 2001, the entire disclosures of which are hereby incorporated by reference.

BACKGROUND OF THE INVENTION

1. Field of the Invention

The subject invention relates to systems for providing an isolation enclosure for patients for whom it is desirable to restrain or isolate to a bed area.

2. Background of the Related Art

Various illnesses and conditions such as brain trauma, dementia and Alzheimer's disease often leave people in such a condition that constant management of the patient is necessary to prevent further injury and mishap. Traditional systems and methods for monitoring and controlling patients with such needs have included bed straps or restraints, straight jackets, sedation, a monitoring device, a dedicated individual at hand, isolation rooms and the like both alone and in combination. Many of these prior art methods and systems are burdensome to all concerned and prohibitively expensive. For example, bed straps immobilize a patient on a bed. When the patient desires to move or change position, the restraints prevent such shifting. As a result, a restrained patient can become very uncomfortable and/or agitated in addition to suffering medical complications. For another example, a dedicated person to attend to the restrained person's needs on an all day, every day basis is cost prohibitive.

Recently, several techniques for addressing confining a patient to a bed area while allowing free movement have been developed to address the needs of the patient and caregiver. Some examples are illustrated in U.S. Pat. No. 5,216,291 to Eads et al. and U.S. Pat. No. 6,263,529 to Chadwick et al., each of which is incorporated herein by reference. However, there are problems associated with the prior art enclosure bed apparatus. Often, the condition which requires restraint may be temporary and as a result transportation, assembly and disassembly of the enclosure may be common. The prior art systems require extensive manpower for assembly and disassembly. When disassembled, loose parts can be lost and transport and storage is cumbersome and difficult. To assemble, tools and excessive know-how and manpower are needed. When assembled, excessive bulk prevents easy transport and storage.

Commonly a patient enters the hospital at the emergency room experiencing symptoms that convince the staff that some form of isolation is in order. Following some initial evaluation, a determination may be made indicating that additional tests, evaluation, admission, surgery, or more acute care is required. As a result, the patient may require transfer to multiple locations within the hospital facility, each requiring some form of isolation sufficient to provide protection to the caregiver(s) or patient. Multiple isolation units as well as the costs for decontamination in each of the various locations not only is extremely expensive but introduces additional risk of contamination. Furthermore, patients on occasion will need to be treated in such a manner that entry into the isolated enclosure is necessary, and therefore an additional airlock enclosure may be needed to facilitate such treatment while maintaining requisite patient isolation.

U.S. Pat. No. 5,314,377 shows a portable, collapsible clean air isolation enclosure that has a top mounted inflatable plenum chamber connected to a source of filtered air to provide a positive or negative pressure sterile or dust free environment, and peripheral curtains sealed at the bottom to the floor. The isolation enclosure of the '377 patent employs the floor as the lower portion of the isolation chamber and therefore would be difficult or impossible to move while in operation because the floor is exposed to any contamination within the enclosure. Moreover, such an enclosure would not be capable of fitting through doors, elevators and the like while in operation due to the fact that it employs the floor as the bottom of the isolation enclosure and to the usage of hinged wings that support the enclosure.

Accordingly, it is an object of the present invention to overcome one or more of the above-described drawbacks and/or disadvantages of the prior art.

SUMMARY OF THE INVENTION

The present invention is directed to an isolation enclosure for isolating a person to an area about a bed, wherein the bed is adapted to support the person and includes a frame and a mattress overlying the frame. The isolation enclosure comprises a frame adapted to surround the bed; and a canopy connectable to the frame and defining an isolation chamber sealed with respect to the ambient atmosphere. The isolation chamber extends over the frame of the bed and is sufficiently large to allow a person located within the isolation chamber to be supported on the bed and to move freely within the isolation chamber. The canopy includes a base wall adapted to at least one of (i) overly the mattress of the bed, and (ii) lie between the mattress and the frame of the bed. A frame transport device, such as wheels, casters, or sliders, is mounted on the frame and adapted to transport the frame and canopy in cooperation with the bed to thereby transport a patient supported on the bed and located within the isolation chamber. The bed and canopy frames either may be formed integral with each other, and mounted on the same transport device, or may be separate from each other and mounted on separate transport devices but configured to be moved in unison in order to transport a patient within the isolation chamber from one location to another. An environmental control device is connectable in fluid communication with the isolation chamber and includes (i) a filter adapted to at least one of filter air entering and filter air exiting the isolation chamber, and (ii) a pump adapted to at least one of pump air into the isolation chamber to increase the pressure within the isolation chamber relative to the ambient atmosphere, and pump air out of the isolation chamber to decrease the pressure within the isolation chamber relative to the ambient atmosphere.

In one embodiment of the present invention, the frame includes an upper laterally extending support, a first upstanding support coupled to a first side of the upper laterally extending support, and a second upstanding support coupled to a second side of the upper laterally extending support. The canopy preferably further includes at least one access portion movable between a closed position and an open position defining an opening through the canopy for allowing access to the isolation chamber, and at least one see-through portion for permitting visual monitoring of the isolation chamber from outside of the canopy The environmental control device preferably includes at least one valve adapted to selectively control the direction of flow of pumped air to either (i) pump air into the isolation chamber to increase the pressure within the isolation chamber relative to the ambient atmosphere, or (ii) pump air out of the isolation chamber to decrease the pressure within the isolation chamber relative to the ambient atmosphere. The environmental control device includes preferably at least one battery for operating the device during transport of a person within the isolation chamber.

The isolation enclosure preferably further comprises an airlock frame releasably connectable to the frame and extending laterally therefrom; and an airlock canopy supported on the airlock frame, and defining a sealed airlock chamber connectable in fluid communication with the isolation chamber and environmental control device. As with the isolation chamber, the environmental control device is adapted to create in the airlock chamber substantially the same or similar pressure conditions as in the isolation chamber, i.e., either a predetermined increase in pressure in comparison to the ambient atmosphere or a predetermined decrease in pressure in comparison to the ambient atmosphere. Preferably, the airlock frame is at least one of telescopically and pivotally mounted to the frame. In one embodiment of the present invention, the environmental control device includes a UV source for sterilizing at least one of air entering the isolation chamber and air exiting the isolation chamber.

Accordingly, an advantage of one aspect of the present invention is found in an enclosure that is easily assembled, disassembled, transported, stored and cleaned.

Another advantage of the present invention is found in the ability to safely restrain or isolate a patient to an area while still allowing for free and comfortable movement within the area.

Still another advantage of the present invention is that the sealed isolation or quarantine enclosure (i.e., a positive pressure or negative pressure enclosure, respectively) can be transported while operating and with a patient located within it, to thereby avoid the need to remove a patient from the enclosure in order to transport the patient from one location to another, such as between different rooms of a hospital.

Yet another advantage of the present invention is found in it flexibility in application. Accordingly, it should be appreciated that the present invention can be implemented and utilized in numerous ways, including without limitation as a process, an apparatus, a system, a device and a method for applications now known and later developed. These and other unique features of the apparatus and method disclosed herein will become more readily apparent from the following description and the accompanying drawings.

BRIEF DESCRIPTION OF THE DRAWINGS

So that those having ordinary skill in the art to which the disclosed invention appertains will more readily understand how to make and use the same, reference may be had to the drawings wherein.

DETAILED DESCRIPTION OF THE PREFERRED EMBODIMENTS

Figure 1:
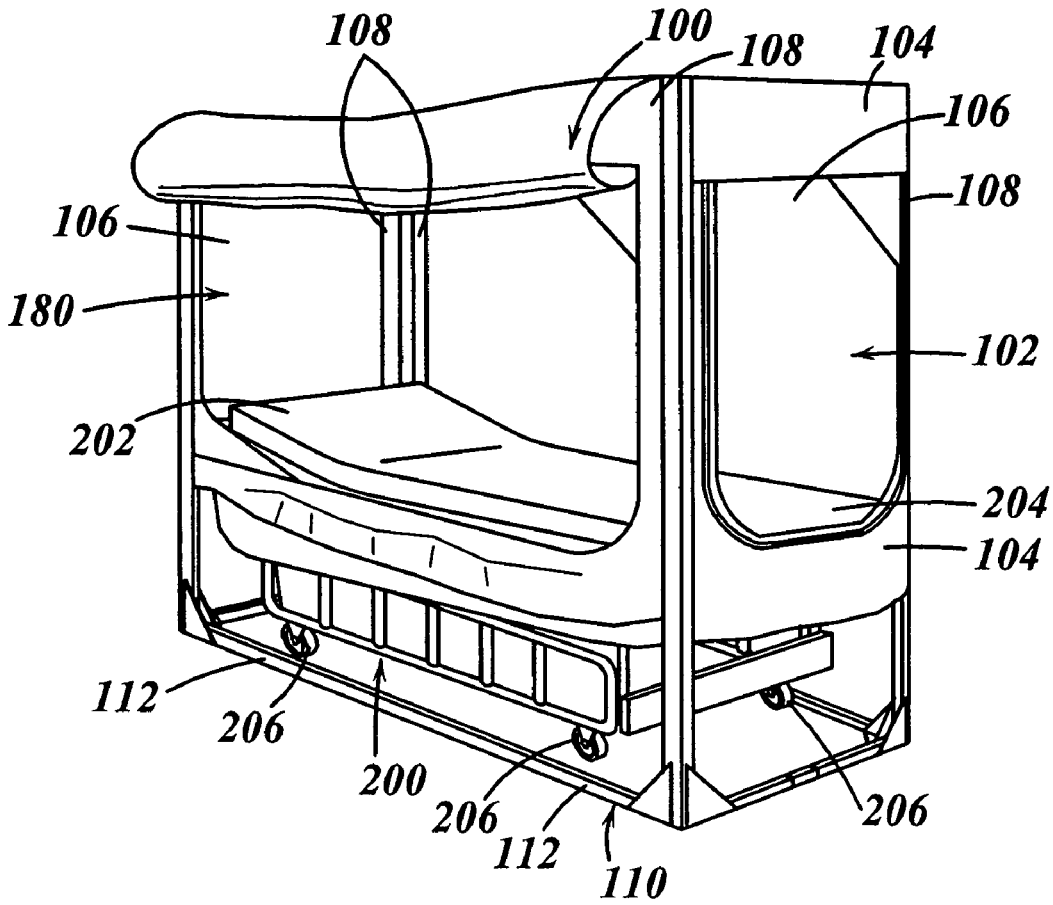
FIG. 1 illustrates a collapsible patient restraining enclosure for a bed positioned about a bed.

The present invention overcomes many of the prior art problems associated with enclosures for restraining or isolating patients to a bed area. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

The subject enclosure safely confines a patient to an area defined around a bed. However, the patient is free to move within the area about the bed. Caregivers and attendants can see into the restrained area. In certain embodiments, caregivers and attendants can access the patient through selectively fastenable openings. The patient has the ability to see and interact with the general environment around the enclosure. In some of the disclosed embodiments, when not in use, the enclosure can be collapsed for easy storage and transport. However, as will be recognized by those of ordinary skill in the pertinent art based on the teachings herein, the canopy and enclosure of the present invention are equally usable with frames that are not collapsible, and/or frames that are mountable on the bed frame, or otherwise fixedly securable to the bed frame.

Referring to FIG. 1, a collapsible enclosure 100 confines a person to their bed 200 without restraints. Typically, the enclosure 100 would be used in a hospital environment with a standard hospital bed 200. The enclosure 100 has a unitary aluminum frame 110 which defines an area of restraint about the bed 200. It is envisioned that the frame 110 can be fabricated from a variety of materials now known and later developed such as steel, PVC pipe, aluminum, plastics, carbon fiber composite, other metals and the like, alone or in combination, to create a suitably robust and lightweight frame 110. In one embodiment, and as shown typically in FIG. 5A, the frame 110 has casters for moving the frame 110.

A canopy 102 is draped about the frame 110 and secured in place to prevent a person from leaving the area of restraint. The canopy 102 leaves access to a portion of the bed 200 for adjustment thereto. The canopy 102 can be secured in place on or over the frame 110 by zippers, fabric sleeves which slide over the frame components, velcro and the like, or combinations thereof as would be appreciated by those of ordinary skill in the art based upon review of the subject disclosure. Zippers 108 allow movement of portions of the canopy 102 to allow access to the area of retention. Preferably, all of the zippers used on canopy 102 are self-locking.

In one embodiment, the canopy 102 drapes on the inside of the frame. Preferably, the canopy 102 is fabricated from a combination of vinyl or nylon portions 104 and netting 106. In a preferred embodiment, the netting 106 is black nylon netting. The advantage of the black color as well as brown, blue and the like is that dark colors allow for improved see-through capability and greater stain resistance. Further, nylon material is substantially lighter than vinyl and therefore easier to handle.

Figure 2A:
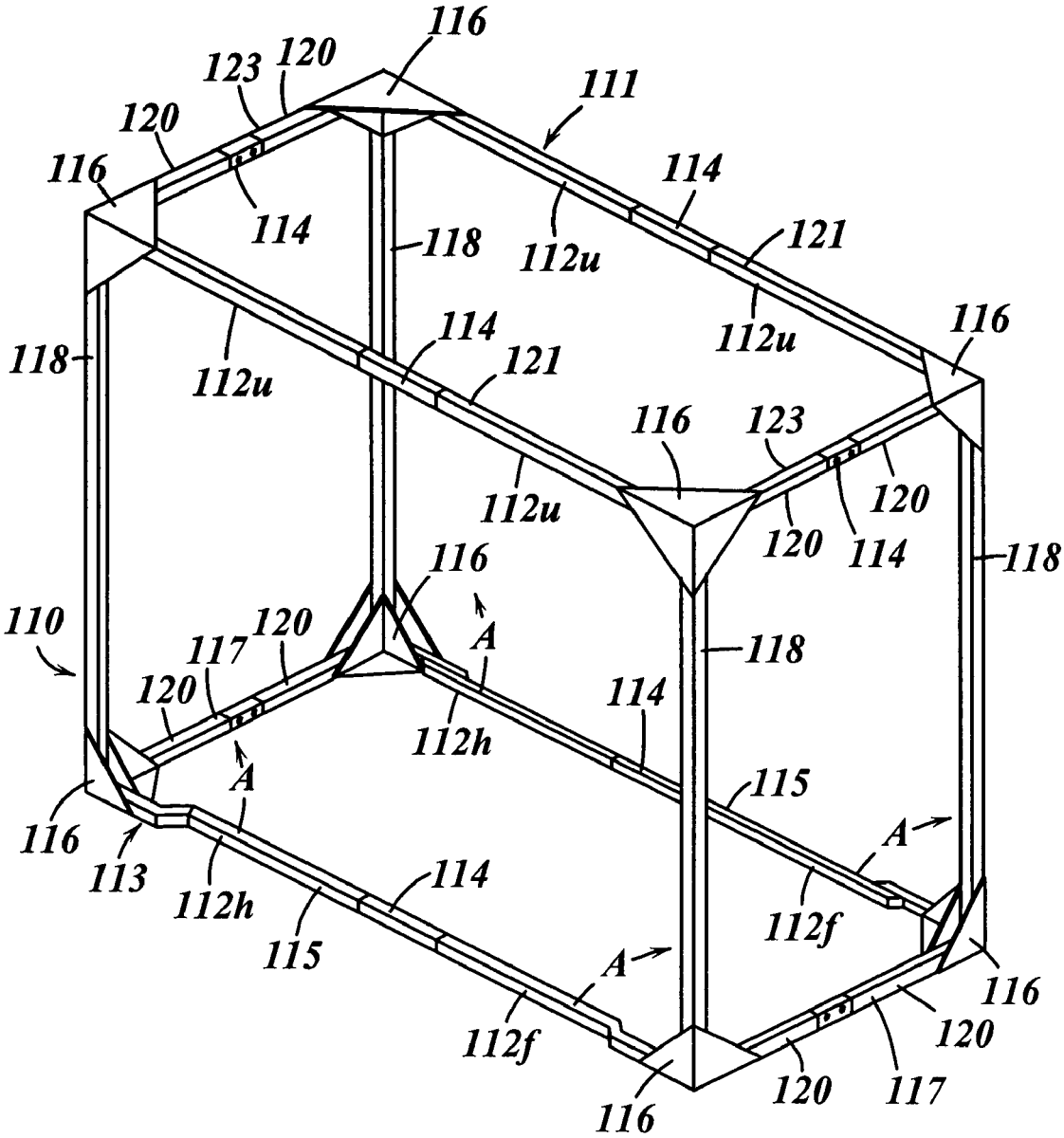
FIG. 2A is a perspective view of an assembled frame of the restraining enclosure of FIG. 1.
Figure 2B:
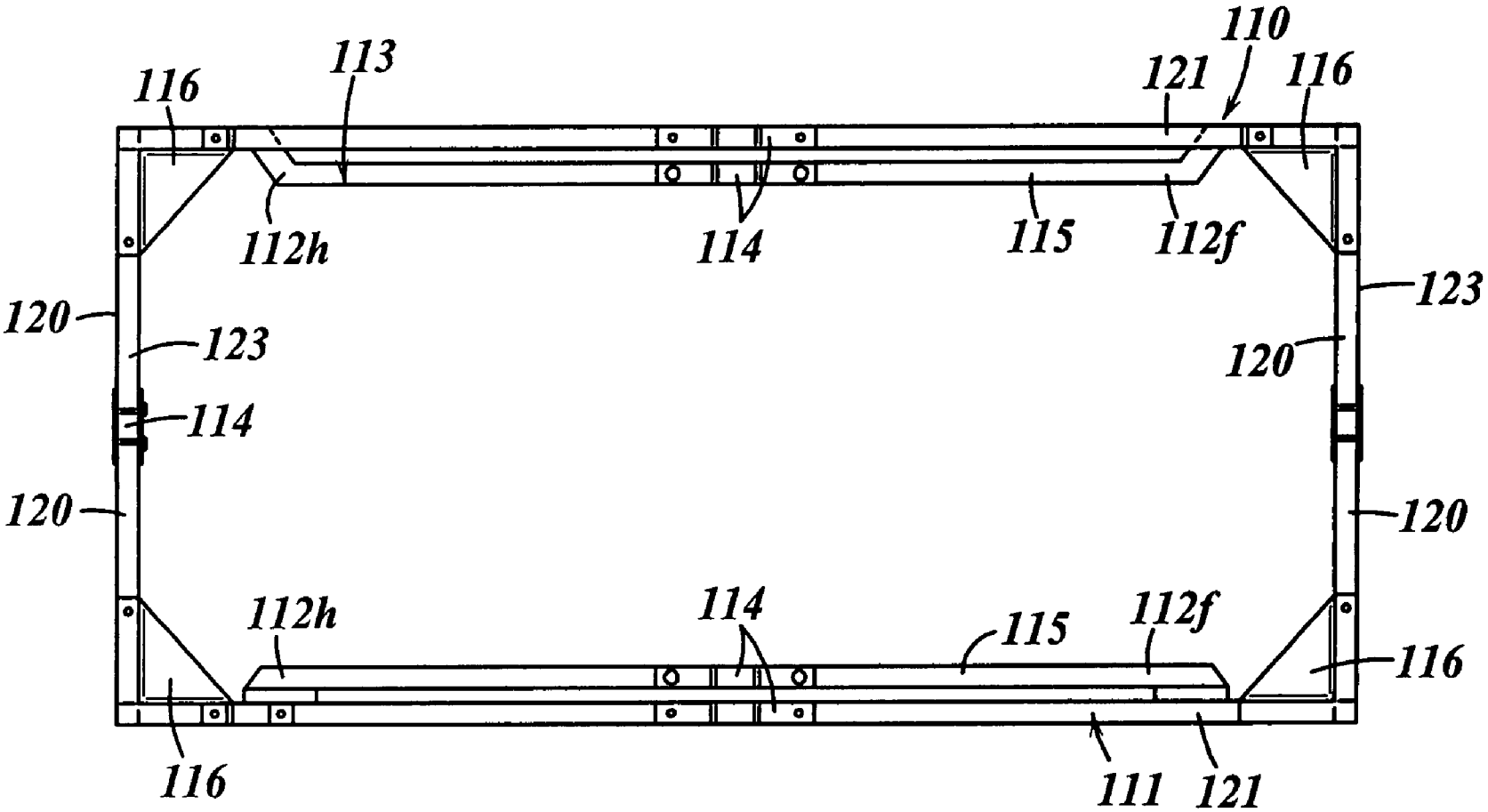
FIG. 2B is a bottom plan view of the assembled frame of FIG. 1.

Now referring to FIGS. 2A and 2B, the frame 110 includes an eave portion 111 supported above a base portion 113 by four vertical bars 118. When assembled, the frame 110 is rigid and supported on the floor by the base portion 113. The bed 200 within the enclosure 100 has a head 202 and a foot 204 (see FIG. 1); thus, the frame 110 has a corresponding head end and foot end, respectively, although the frame 110 as shown is symmetrical. Preferably, the strength and stability of the frame 110 is such that an adult could robustly attempt exit without damage to the frame 110 or tipping the frame 110 over.

As shown in FIG. 2A, the base portion 113 has two non-linear substantially parallel elongated supports 115, each support 115 having a head portion 112*h* and a foot portion 112*f*. The head portion 112*h* and the foot portion 112*f* are linked by a coupling 114. Two parallel transverse supports 117 extend between the non-linear supports 115 to substantially form a rectangle approximately the size of a standard hospital bed 200. The transverse supports 117 include two portions 120 linked by a coupling 114. Traditionally, the standard hospital bed 200 is approximately 90.25.times.36.64 inches, although it will be appreciated that the enclosure 100, in particular the rectangle formed by the base portion 113 and eave portion 111, is well suited to adaptation to beds of any size.

Four lower corner brackets 116 secure the elongated supports 115 and transverse supports 117 of the base portion 113 in such a manner that both supports 115, 117 can selectively rotate. Preferably, each coupling 114 is pivotably connected and located intermediate each support 115, 117 for facilitating collapsing the frame 110 as will be described hereinbelow with respect to FIGS. 4 and 5. The central region of each elongated support 115 of the base portion 113 is offset towards the interior of the enclosure 100 for facilitating collapsing the enclosure 100 as well.

The eave portion 111 is supported above the base portion 113 by four vertical, parallel rectangular bars 118. Two linear parallel elongated supports 121 extend between a head end and a foot end of the eave portion 111. Two parallel transverse supports 123 extend between the elongated supports 121 to form a rectangle therewith approximately the size of a standard hospital bed 200. Four upper corner brackets 116 secure the supports 121, 123 of the eave portion 111 in such a manner that each of the supports can selectively rotate downward therefrom. Preferably, each of the supports 121, 123 of the eave portion 111 has pivot devices couplings 114 located intermediate their length for facilitating collapsing the frame 110.

Still referring to FIGS. 2A and 2B, when assembled, the corner brackets 116 rigidly secure the four vertical bars 118 thereto. In another embodiment, the four vertical bars 118 are integral with the corner brackets 116. In another embodiment, the supports 121, 123 of the eave portion 111 are monolithic and selectively detach from the corner brackets 116 for partial disassembly. In still another embodiment, the head end and the foot end of the eave portion 111 are supported above the base portion 113 by two solid panels as would be appreciated by those of ordinary skill in the pertinent art based upon review of the subject disclosure, and shown in phantom lines on FIG. 4. In yet still another embodiment, only elongated or transverse parallel pairs of parallel supports of the eave and base portions include pivoting couplings 114, thus the frame only partially collapses.

In order to position the bed 200 within the enclosure 100, the head end 112*h* and the foot end 112*f* of the base portion can be disconnected at an intermediate point via coupling 114 and rotated upwards along arrow A (FIG. 2A). Since the bed 200 is commonly mounted on wheels 206, the bed 200 can be rolled into the enclosure 100 without interference. Upon positioning the bed 200 within the enclosure 100, the head end 112*h* and the foot end 112*f* are rotated downwards and secured together with coupling 114. At such time, a mattress is placed inside the canopy 102, or underneath the bottom wall of the canopy, and the patient may be placed in the bed 200 and the canopy 102 secured in place. Alternatively, the canopy 102 may be secured in place about the frame 110 and the patient may enter the restraining area through an opening 180 in the canopy 102 (FIG. 1). In another embodiment, there is no base portion. In one such embodiment without a base portion, the four vertical bars 118 would terminate in foot plates. In another embodiment, the four vertical bars 118 terminate in a post adapted and configured for insertion in the headboard and footboard slots of a standard hospital bed 200. Thus, to erect the enclosure about the bed 200, the headboard and footboard are removed and the four vertical bars are inserted therein. Alternatively, the four vertical bars could bolt onto a bed or an adapter plate could facilitate secure locking engagement to a bed.

Referring to FIGS. 3A through 3D, a corner bracket 116 has a base component 140 and an upper component 142 which are preferably made from metal and welded or riveted together. The base component 140 has a substantially triangular platform 148 with two upstanding triangles 149 on edges thereof. The two upstanding triangles 149 define a channel 151 for receiving a portion of a vertical bar 118. The upper component 142 has a flange 143 for engaging the base component 140 and two upstanding triangles 145. As shown typically in FIG. 3D, the vertical bars 118 are also welded, riveted or otherwise fixed securely to the corner brackets 116. An angle iron 144 (FIG. 3D) is welded or riveted to the upper component 142 and vertical bar 118 for additional support, fit and rigidity. It is envisioned that the vertical bars 118, base component 140, upper component 142 and angle iron 144 may be of monolithic construction, riveted, screwed, glued or the like, in order to form a desired shape which performs the necessary function. In another embodiment, instead of an angle iron 144 for extra structural support, the shape of the corner brackets 116 is modified to conform to the vertical bar 118 for fixedly securing the vertical bar 118 thereto.

Figure 3A:
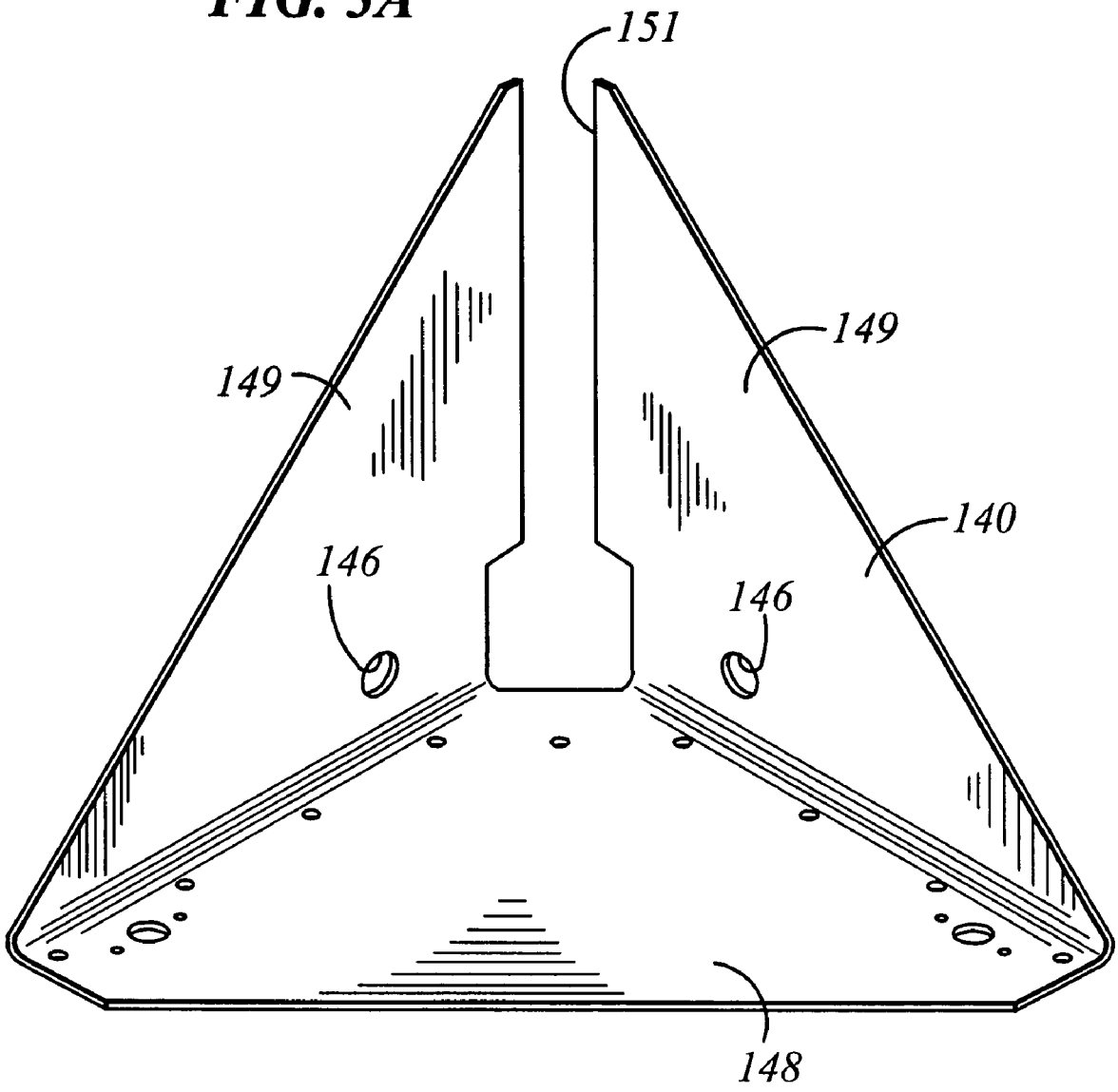
FIG. 3A is a perspective view of an outer portion of a corner bracket of the frame of FIG. 1.
Figure 3B:
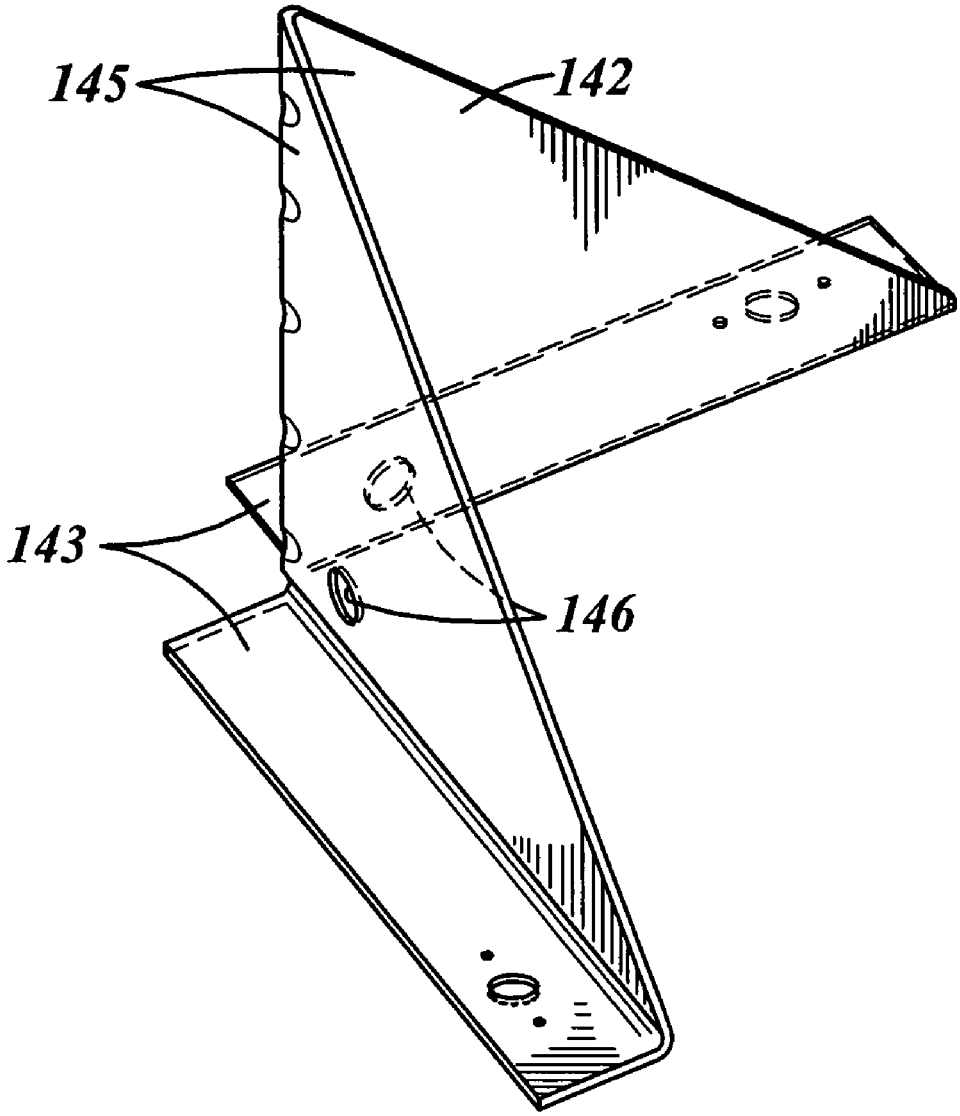
FIG. 3B is a perspective view of an inner portion of a corner bracket of the frame of FIG. 1.
Figure 3C:
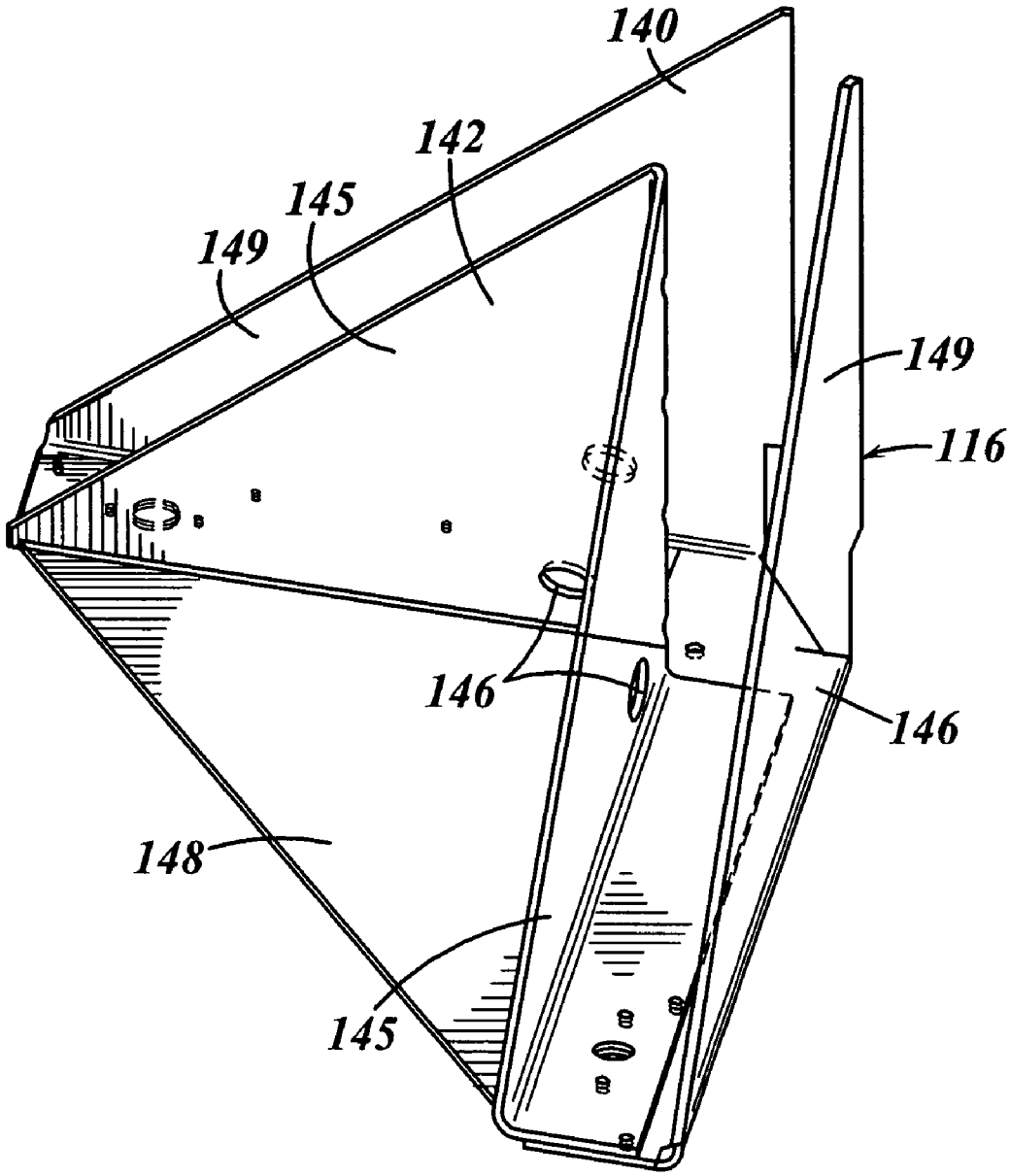
FIG. 3C is a perspective view of a partially assembled corner bracket of the frame of FIG. 1.
Figure 3D:
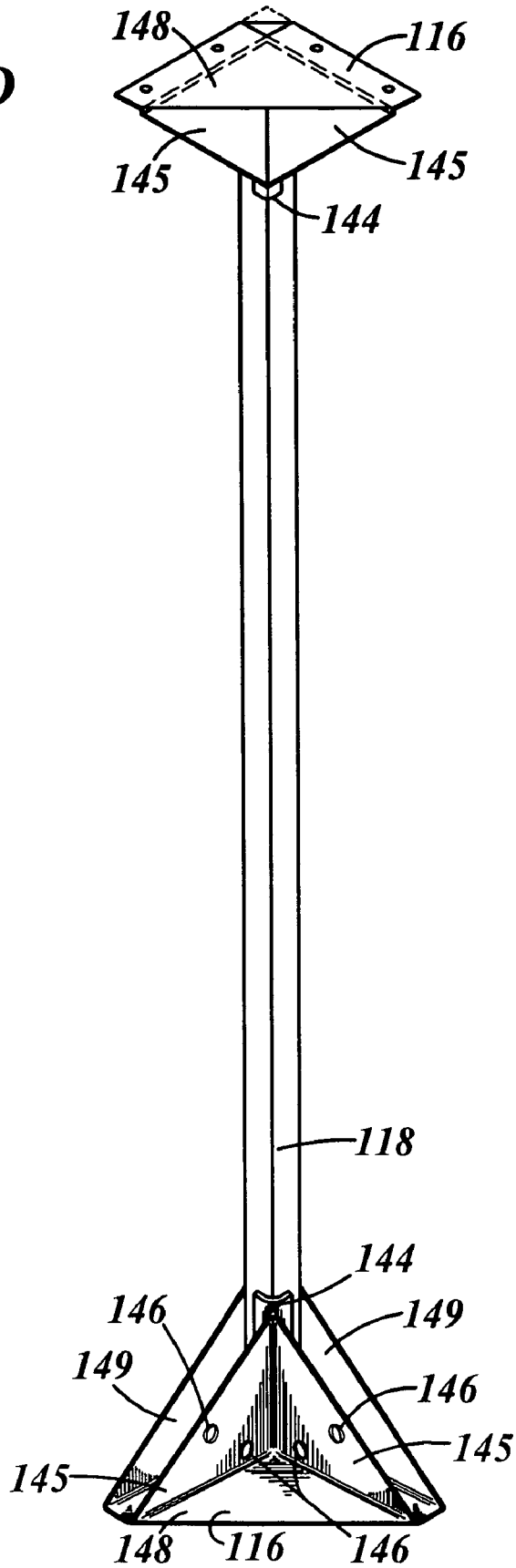
FIG. 3D is a perspective view of two partially assembled corner brackets secured to a vertical bar of a frame of the restraining enclosure of FIG. 1.
Figure 3E:
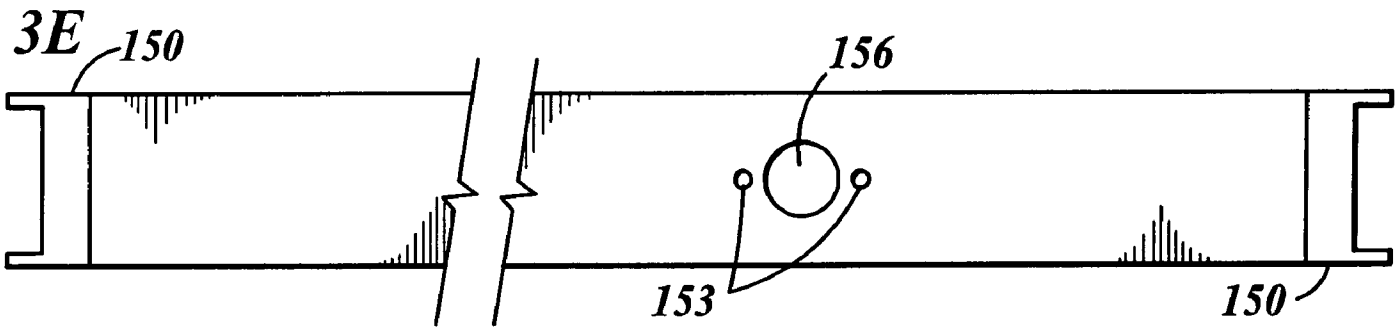
FIG. 3E is a top view of an end of a support of the frame of FIG. 1.
Figure 3F:
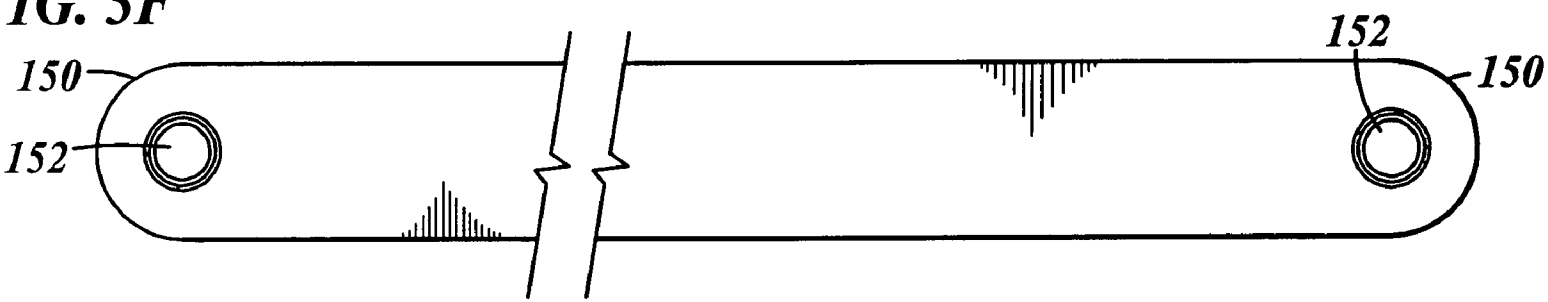
FIG. 3F is a bottom view of an end of a support of the frame of FIG. 1.
Figure 3G:
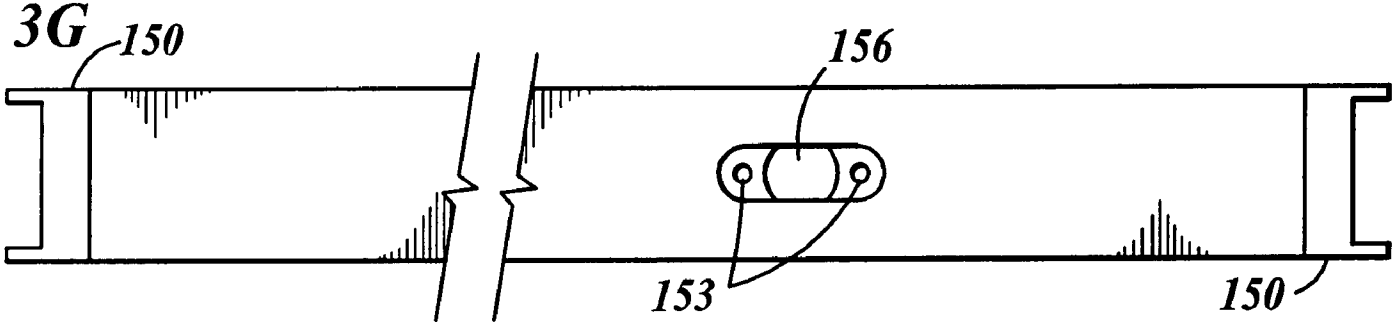
FIG. 3G is a side view of an end of a support of the frame of FIG. 1.
Figure 3H:
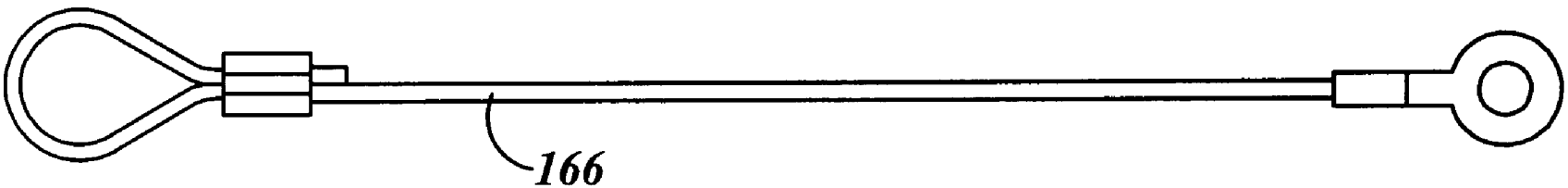
FIG. 3H is a perspective view of a tether of the restraining enclosure of FIG. 1.
Figure 3J:
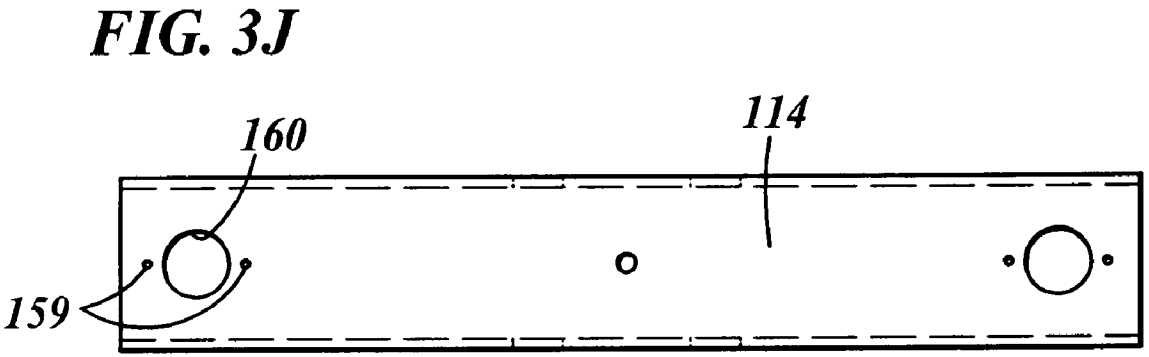
FIG. 3J is a side end view of a coupling of the frame of FIG. 1.
Figure 3I:
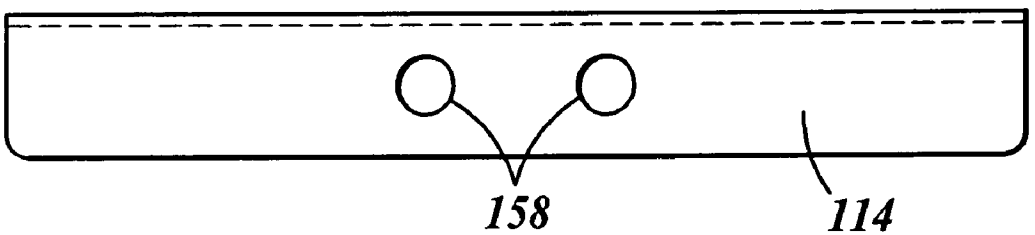
FIG. 3I is a top view of a coupling of the frame of FIG. 1.
Figure 3K:
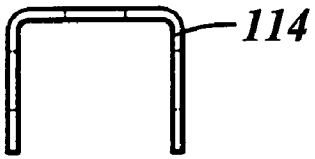
FIG. 3K is an end view of a coupling of the frame of FIG. 1.
Figure 3L:
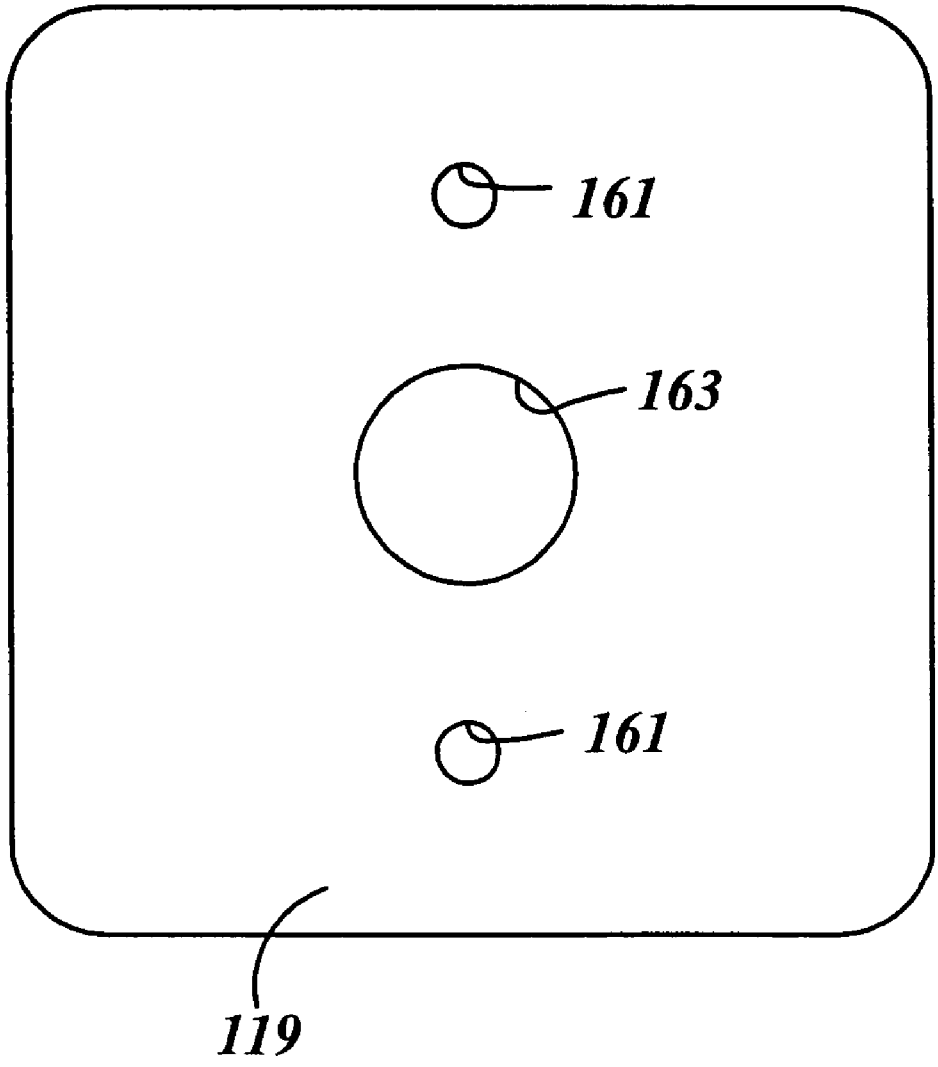
FIG. 3L is a plan view of a nut plate of the frame of FIG. 1.

Referring now to FIGS. 3E through 3H, the ends 150 of the supports 115, 117, 121, 123 (FIG. 2A) of the base portion 113 and eave portion 111 rotatably couple to the corner brackets 116. With respect to FIG. 3F, the ends 150 of the supports preferably are rounded and define a pivot passage 152 for receiving a pin (not shown). The pin also extends through holes 146 (FIGS. 3A-3D) formed in the corner brackets 116. The pin may be held in place by a cotter pin and the like and secured to the frame 110 by a nylon coated stainless steel tether 166 as shown in FIG. 3H. In one embodiment, a teflon bushing is inserted in the pivot passage 152 to enhance the smooth rotation and wear characteristics. A locking fastener (not shown) such as a captive screw secures the supports 115, 117, 121, 123 rigidly to the corner brackets 116 for assembly. Preferably, the locking fastener extends through aligned holes (not shown) in the supports 115, 117, 121, 123 and corresponding corner brackets 116. The aligned holes may be threaded or a nut and bolt combination may be used to fix the supports 115, 117, 121, 123.

Referring to FIGS. 3E through 3L, couplings 114 selectively rotatably or rigidly secure together the intermediate ends of the supports 115, 117, 121, 123. A pivot pin (not shown) rotatably secures the intermediate ends 150 of the supports 115, 117, 121, 123 to the couplings 114 by extending through holes 152 in the supports 115, 117, 121, 123 and openings 158 in the couplings 114. To fix the supports 115, 117, 121, 123 rigidly, a pin and fasteners (not shown) extend through holes 159, 160 of the coupling 114 (FIG. 3J), respectively, into holes 153, 156 respectively, of the supports 115, 117, 121, 123 (FIGS. 3E and 3G). Preferably, a pair of nut plates 119 spreads the connection force over an area of the supports 115, 117, 121, 123. For example, the pins extend into openings 163 on the nut plates 119, and the nut plates 119 are held in place about each side of the channel 156 of end 150 by the fasteners which pass through holes 161 of one of the nut plates 119 and thread into the opposing nut plate 119 by corresponding holes 161. Preferably, the pins and fasteners have locking rings to facilitate captive engagement with the nut plates 119 to prevent loss when disassembled and to provide efficient storage thereof. In another embodiment, teflon bushings (not shown) are pressed into the central openings 156 to alleviate the need for exceptionally tight tolerancing for a snug fit.

Figure 4:
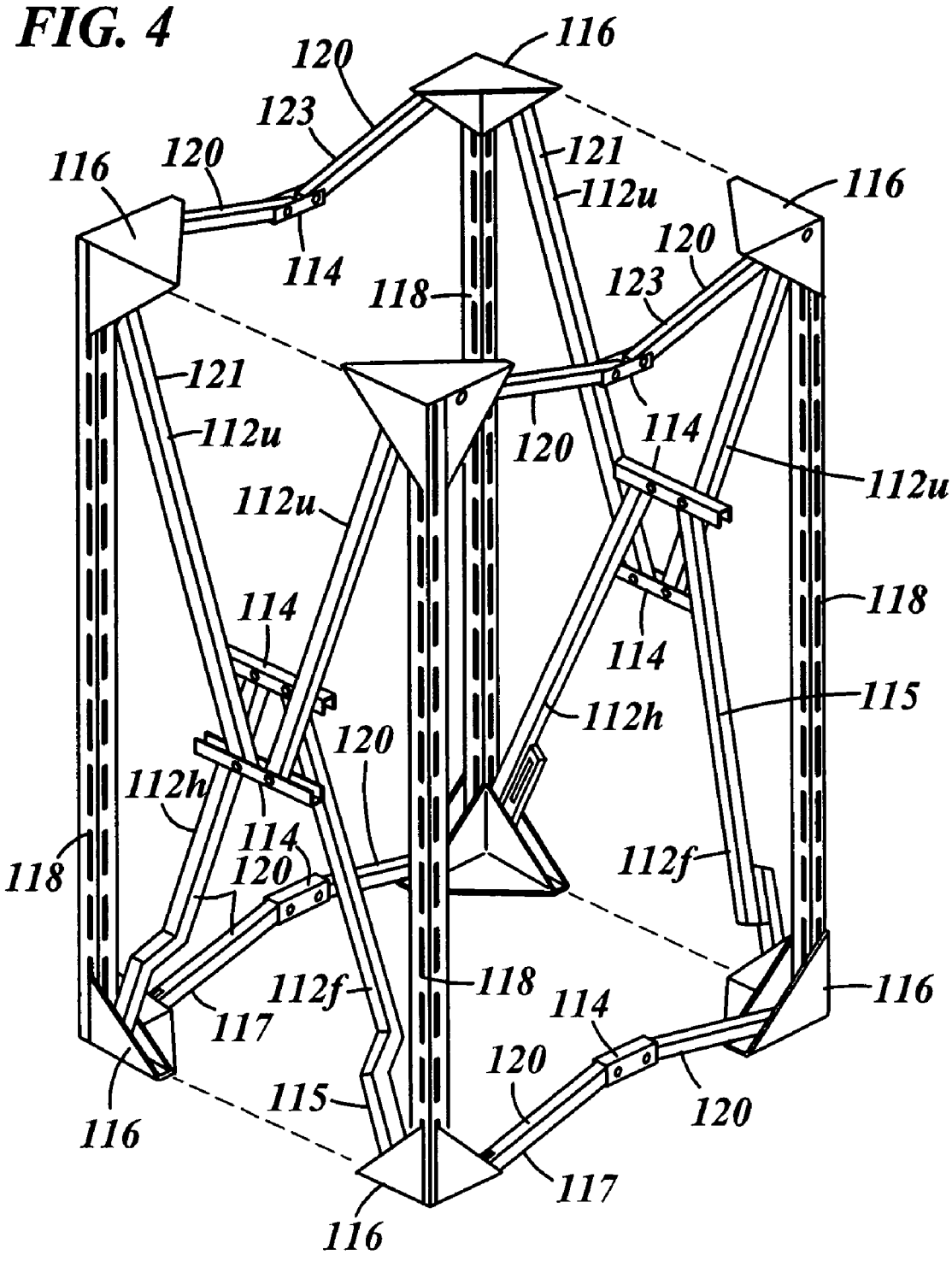
FIG. 4 is a perspective view of the frame of FIG. 1 in a partially collapsed state.
Figure 5:
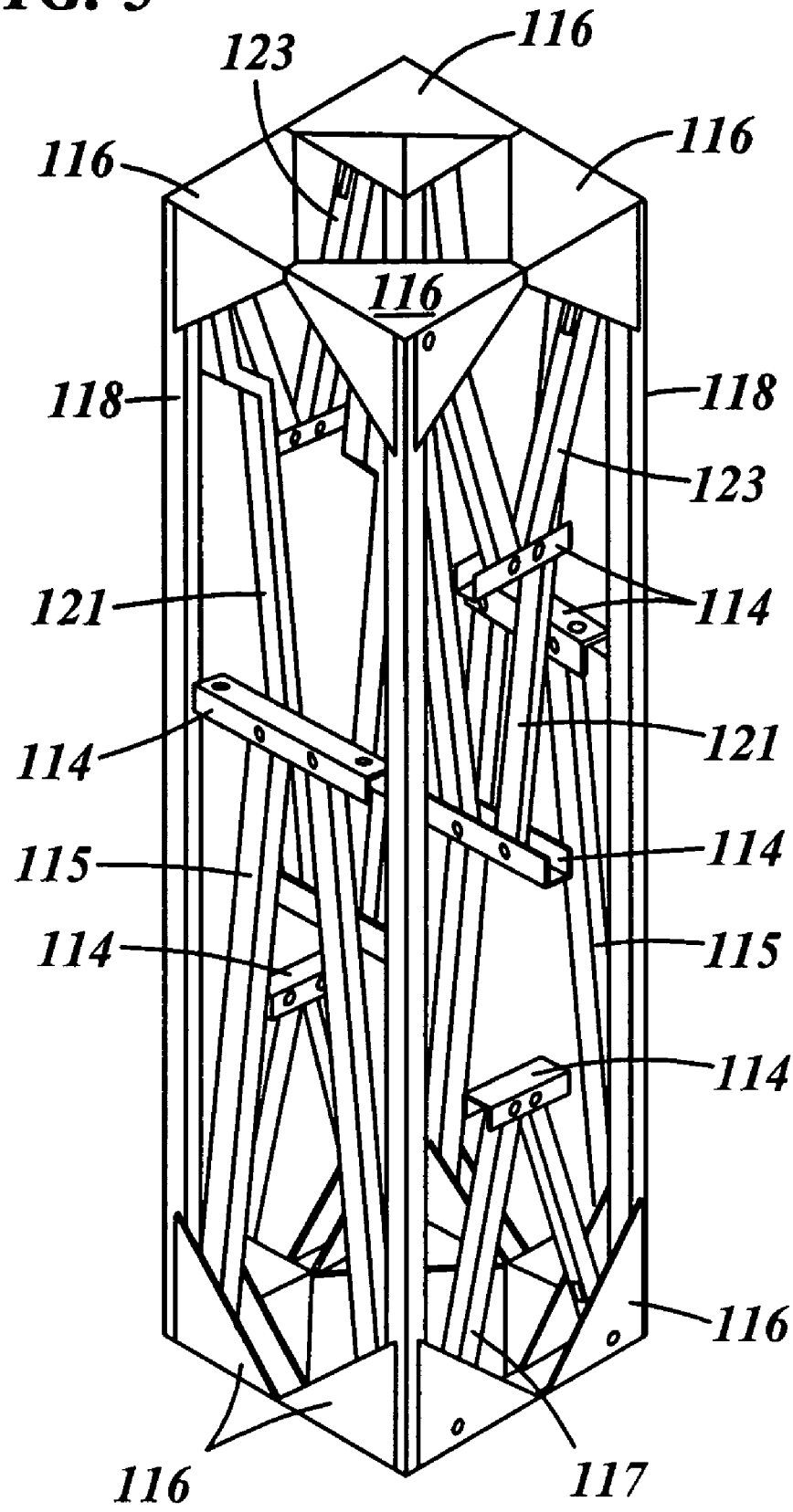
FIG. 5 is a perspective view of the frame of FIG. 1 in a fully collapsed state.
Figure 5A:
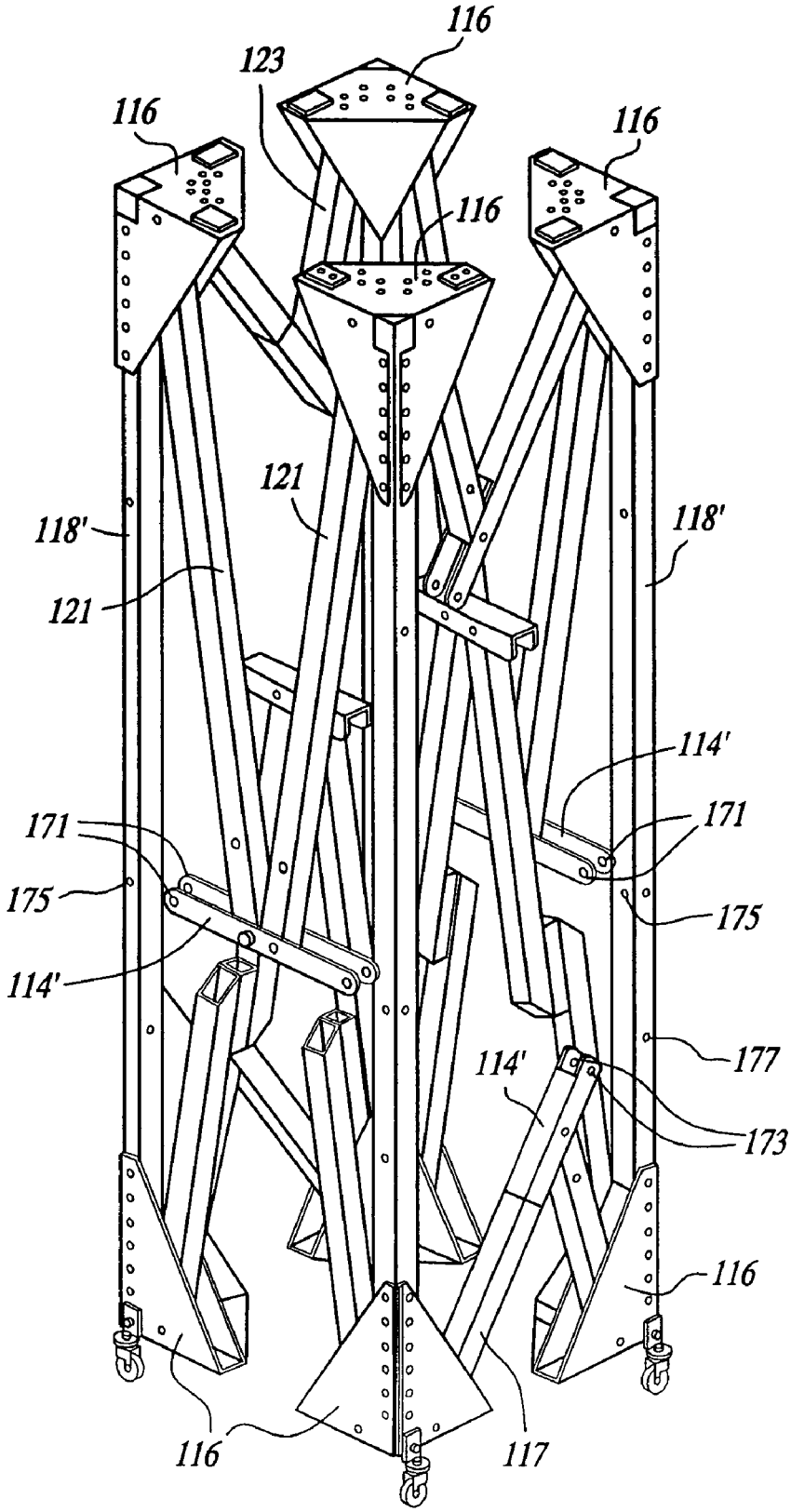
FIG. 5A is a perspective view of another embodiment of a collapsible frame including alignable apertures and quick-connect fasteners tethered to the frame and receivable within the aligned apertures to lock the frame in a collapsed or minimized position.
Figure 5B:
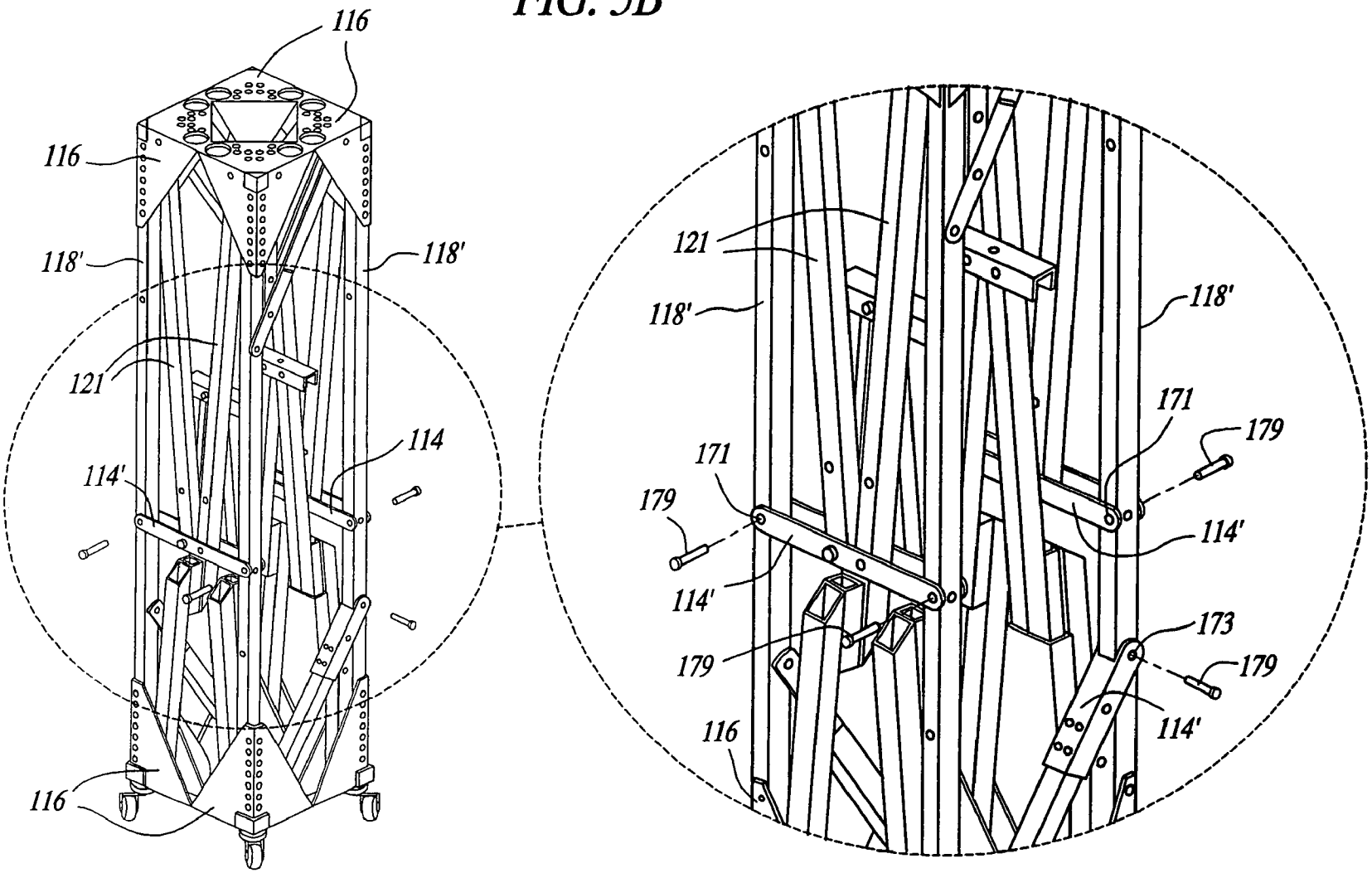
FIG. 5B is a partial, perspective view of the frame of FIG. 5A illustrating the insertion paths of the quick-connect fasteners for locking the frame in the collapsed position.

Referring to FIGS. 4 and 5, the corner brackets 116 and the couplings 114 of the frame 110 have been released to allow collapsing the frame 110 for transportation and storage. Upon release, the four vertical bars 118 remain upright and are brought together. As the four vertical bars 118 are brought together, each of the supports 115, 117, 121, 123 pivotally hinges at the respective corner bracket 116 on one end and at the respective coupling 114 on the inner end. The height of the four bars 118 is selected such that the inner ends of the transverse supports 123 of the eave portion 111 and the inner ends of the transverse supports 117 of the base portion 113 do not overlap. However, the inner ends of the elongated supports 121 of the eave portion 111 and the inner ends of the elongated supports 115 of the base portion 113 do overlap. To accommodate the overlap, the nonlinear shape of the elongated support members 115 of the base portion 113 prevent interference between the central region of the eave portion's elongated supports 121 and the base portion's elongated supports 115 when fully collapsed. As a result, the frame 110 can be minimized for storage and transport as shown in FIG. 5. Preferably, a strap (not shown), attached to the frame 110, is used to secure the frame 110 in the minimized position. In another embodiment, the collapsed frame 110 is stored within a transport bag. In still another embodiment illustrated in FIGS. 5A and 5B, the couplings 114' of the upper supports 121 define aligned pairs of first apertures 171 on opposite ends thereof, and the couplings 114' of the lower supports 123 each define an aligned pair of second apertures 173 on one end thereof. The upstanding supports 118 each define third apertures 175 extending through the mid-portions thereof, and define fourth apertures 177 angularly spaced about 90° relative to each other, and axially spaced about mid-way between the respective third apertures 175 and base support 116. As shown in FIG. 5B, when located in the fully-collapsed condition, the first apertures 171 are aligned with the third apertures 175, the second apertures 173 are aligned with the fourth apertures 177, and fasteners 179 are receivable through the aligned apertures to lock the frame in the collapsed condition. The illustrated fasteners 179 are quick-connect pins of a type known to those of ordinary skill in the pertinent art that are tethered to the frame with, for example, tethers of the type illustrated in FIG. 3H. As may be recognized by those skilled in the pertinent art based on the teachings herein, the fasteners 179 may take the form of any of numerous different types of fasteners that are currently known, or that later become known, for performing the function of the fasteners as described herein. It also will be appreciated by those skilled in the pertinent art based upon review of the subject disclosure that the collapsible frames may be collapsed with the canopy in place.

Figure 6:
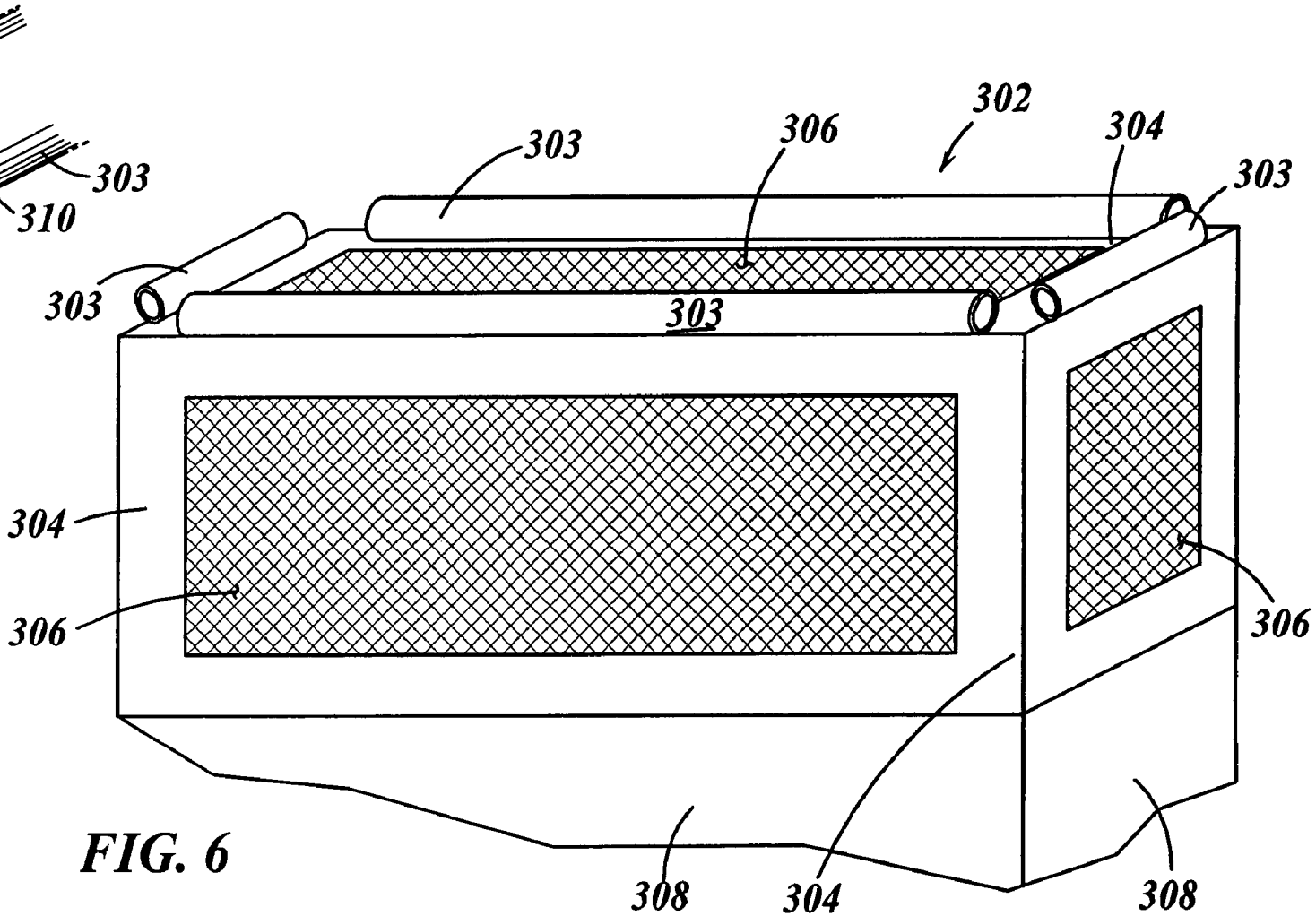
FIG. 6 is a perspective view of a canopy for another embodiment of an enclosure.
Figure 7:
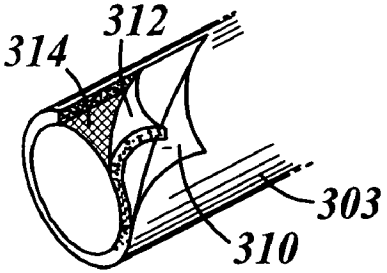
FIG. 7 is a partially disassembled view of a sleeve of the canopy of FIG. 6.

Referring to FIGS. 6 and 7, another illustrative embodiment of a canopy is indicated generally by the reference numeral 302. The canopy 302 is similar to the canopy 102 described above, and therefore like reference numerals preceded by the numeral "3" instead of the numeral "1" are used to indicate like elements. Thus, the mesh or netting 306 is sized and colored (i.e., a dark colored mesh defining a color selected from the group including black, blue and brown) for enhanced see-through capability and stain resistance as described above, and to prevent unwanted objects or articles, such as a patient's fingers, from passing therethrough. The canopy 302 drapes down from the eave portion 111 of the frame 110 (FIG. 2A) by sleeves 303. The canopy 302 leaves access to a portion of the bed for adjusting the bed. Preferably, the canopy 302 has zippers (not shown) in lower panels 308 to provide such access as would be well within the skill of one in the pertinent art. As shown typically in FIG. 7, the sleeves 303 are fabricated from a combination of nylon 310, foam 312 and mesh 314. The foam 312 acts as padding for the frame 110. In a preferred embodiment, the foam 312 is a closed cell padding material to prevent water absorption and the mesh 314 allows water drainage and drying after the canopy 302 has been washed. As shown typically in FIG. 7, each sleeve 303 defines an axially-elongated seam to facilitate attachment of the sleeve to a respective support 112 or 120 of the frame 110 (FIG. 2A). As is understood by those or ordinary skill in the pertinent art based on the teachings herein, each seam may include any of numerous different devices that are currently known, or that later become known for securing the sleeve in a closed position over the respective frame support, such as a zipper, or a hook and loop (Velcro™) device. In another embodiment, sleeves are provided for securing the canopy 302 to the vertical bars 118 of the frame 110 as well.

Figures 8A, 8B:
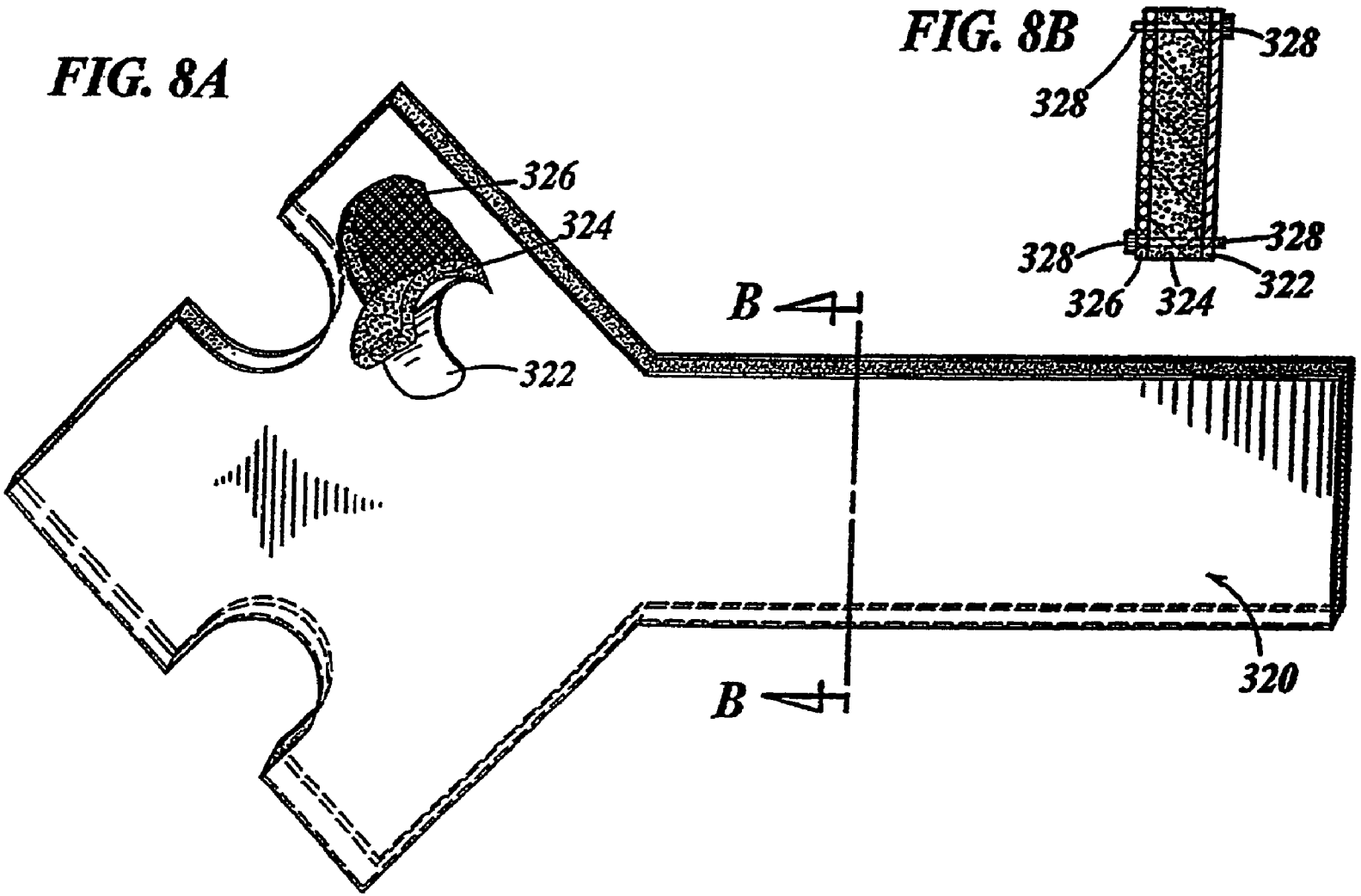
FIG. 8A is a partially disassembled view of an exemplary collar assembly for use with the canopy of FIG. 6.
FIG. 8B is a cross-sectional view of the collar assembly of FIG. 8A taken along line B-B.

Referring to FIGS. 8A and 8B, a collar assembly 320 is fitted to each vertical bar 118 (FIG. 2A) to prevent injury to the restrained patient. Additional collar assemblies 320 may be fitted and used to cover any portion of the frame which may pose potential for injury to a patient. The collar assemblies are also composed of nylon 322, foam 324, mesh 326 and fasteners 328 to allow for easy maintenance, assembly and protection of the patient from injury against the frame 110. The collar assemblies 320 are contoured for snugly and aesthetically fitting against the frame 110. The fasteners 328 are used to insure a snug fit of the collar assemblies 320 onto the frame 110. Preferably, the fasteners 328 are hook and loop fabric pairs.

Figure 9:
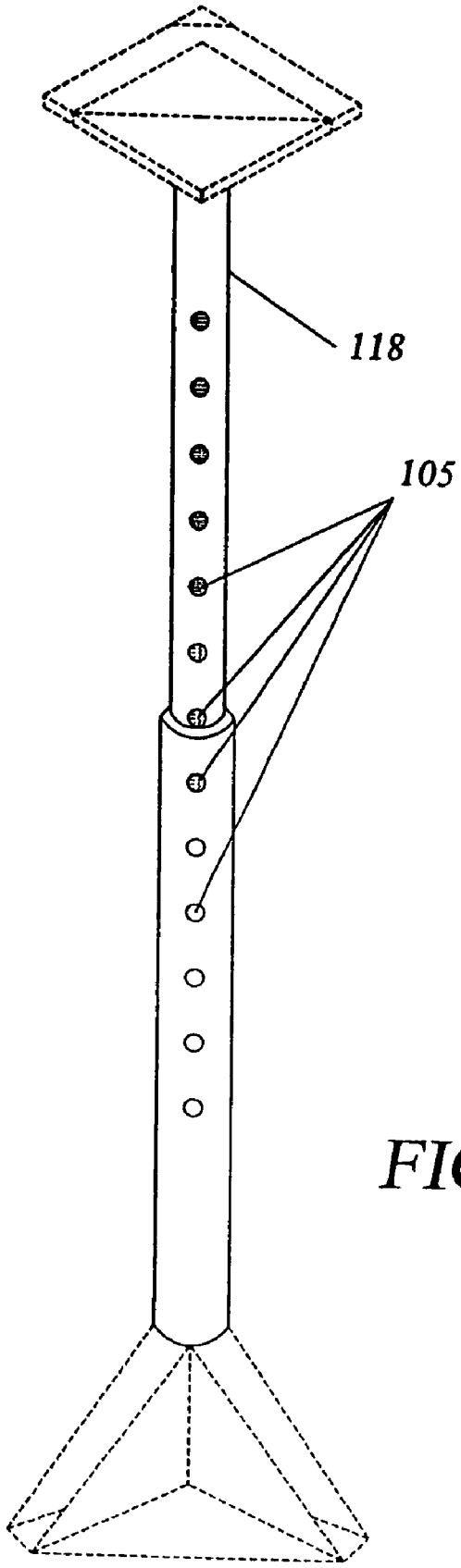
FIG. 9 is a perspective view of an exemplary frame support having telescopic characteristics.

As will be recognized by those or ordinary skill in the pertinent art based on the teachings herein, the illustrated canopies are usable with any of numerous different types of frames that are currently known, or that later become known. For example, the canopies may be used with frames that are not collapsible, frames that collapse in a different manner than the frame 110 as described above, or frames that are adjustable in size. For example, as shown in FIG. 9, one or more supports 118 of the frame may be telescopic with securing elements 105 for enabling the frame to be adjustably sized as desired to accommodate different sized beds (e.g., infant, toddler, twin, full, queen or king sized beds). Such telescopic supports may be employed in either a collapsible frame as described above, or in a non-collapsible frame. In addition, the canopies equally may be usable with frames that are not foldable or otherwise collapsible, but rather are fixed in position and moved whole, or require the fixedly secured parts of the frame to be disassembled to transport or store the enclosure. Such non-collapsible frames may be mounted on the floor surrounding the bed as illustrated in FIG. 1, may be fixedly secured to the bed frame and movable therewith on, for example, casters spaced laterally from the bed, may be mounted on the bed frame to form a combined bed and enclosure frame, or may be mounted on means for transporting the frame with or without the bed, such as wheels, casters, bearings or other devices for rolling, sliding or otherwise transporting the frame that are currently known, or that later become known. Such frames also may be modular, such that separable frame modules or sub-assemblies can be disassembled from each other to transport or store the frame. In addition, the canopy may define a sealed enclosure for isolating a patient therein, wherein a base wall of the canopy overlies the bed, and if desired, the mattress of the bed, to prevent contamination of the bed and mattress, and wherein the canopy and frame are transportable with the bed to transport the patient within the enclosure from one location to another.

Figure 10:
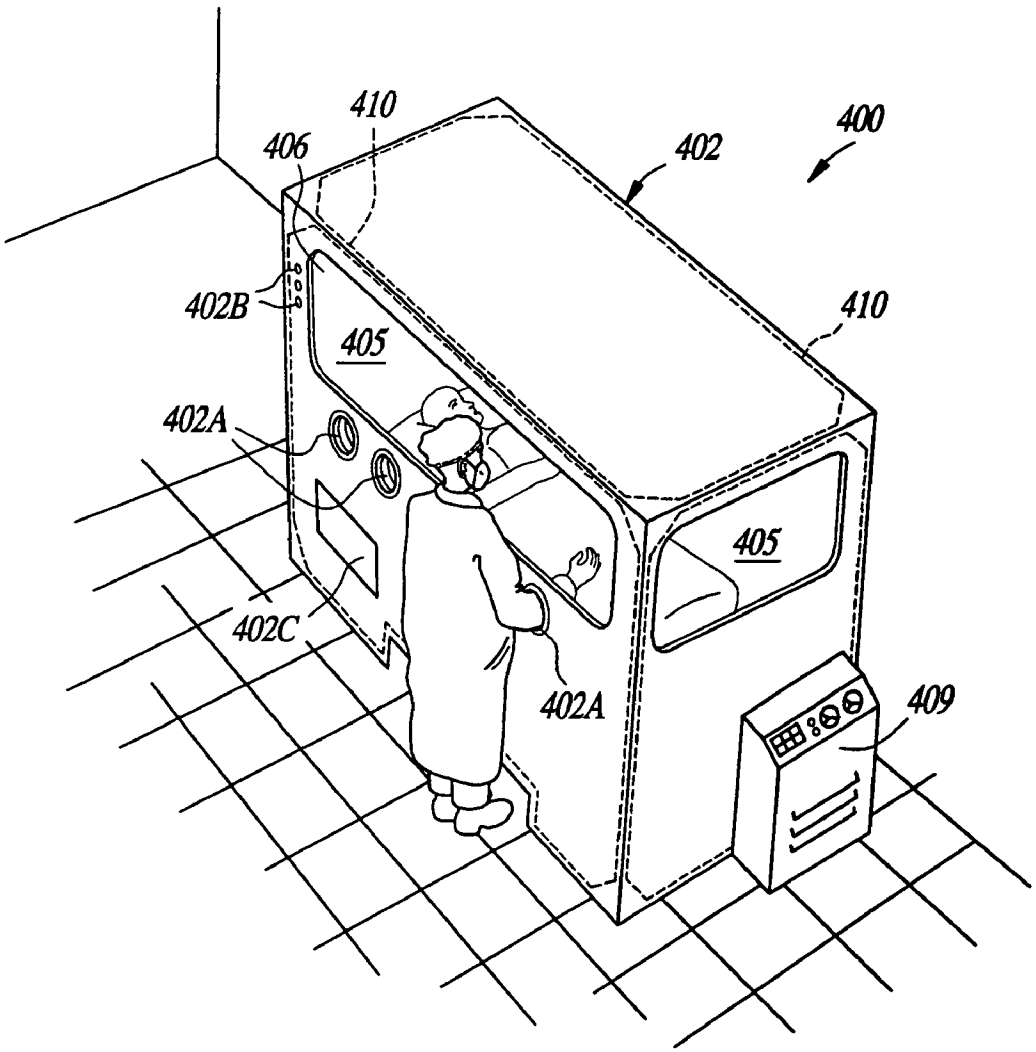
FIG. 10 is a perspective view of another embodiment of an enclosure of the present invention that is particularly suited for use as a quarantine enclosure or as a patient isolation unit.
Figure 11:
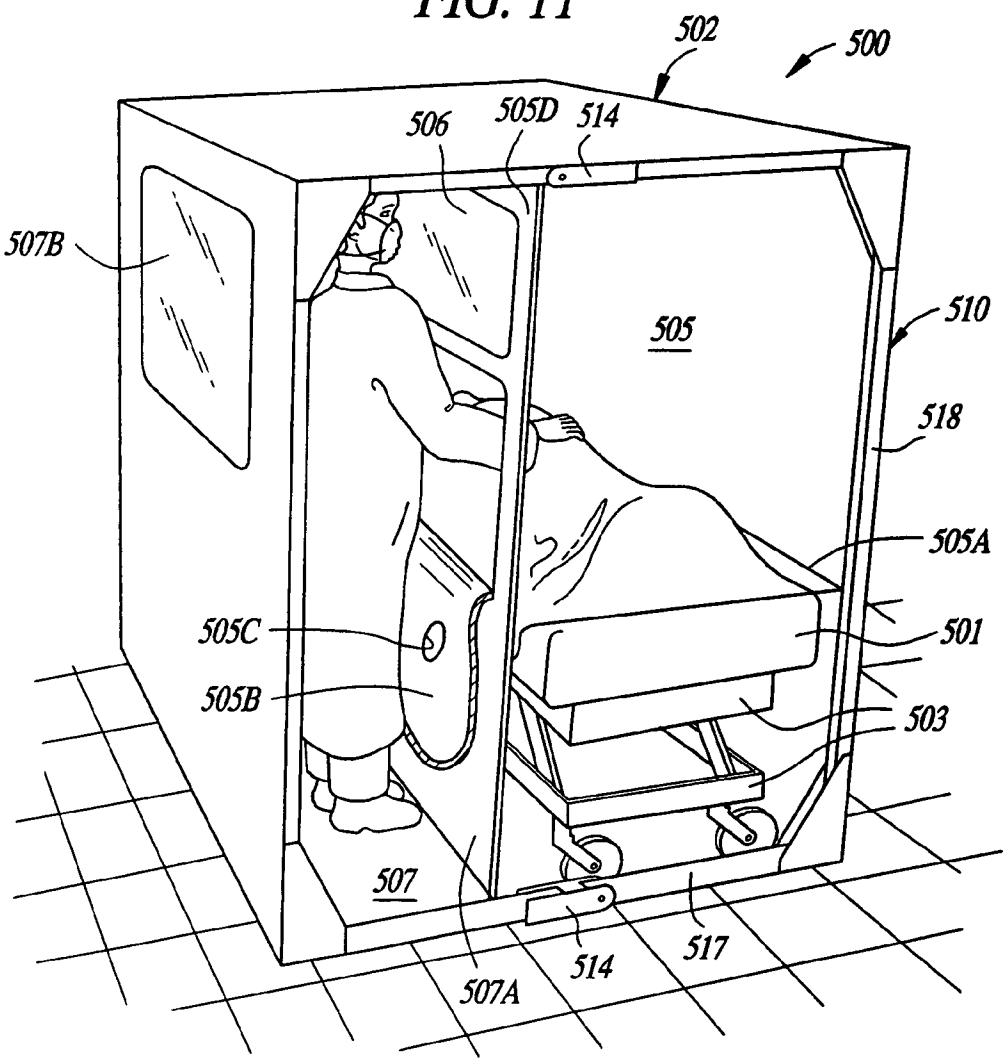
FIG. 11 is a part-sectional, perspective view of another enclosure of the present invention suited for use as a quarantine enclosure or as a patient isolation unit.
Figure 12:
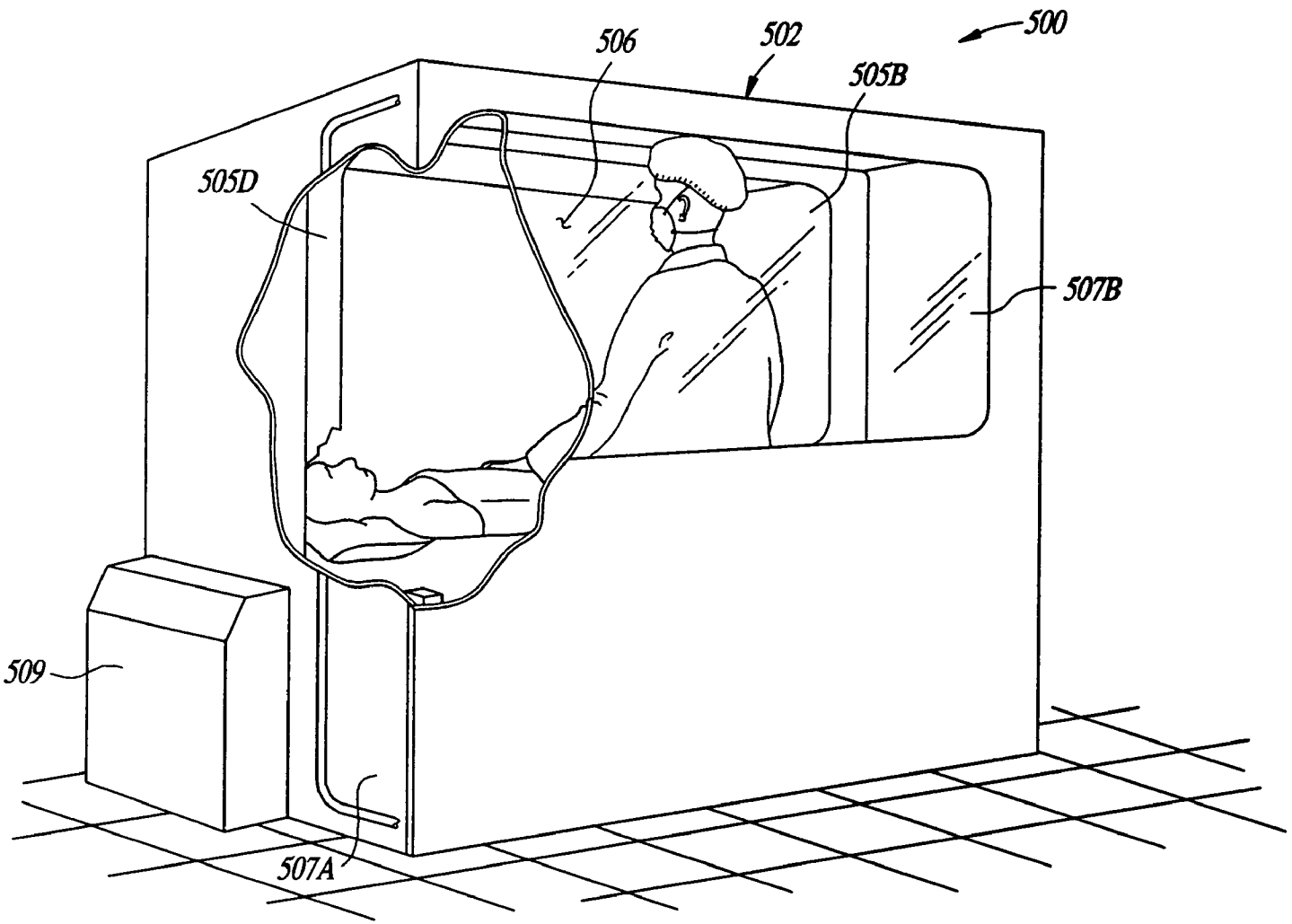
FIG. 12 is another part-sectional, perspective view of the enclosure of FIG. 11.
Figure 13:
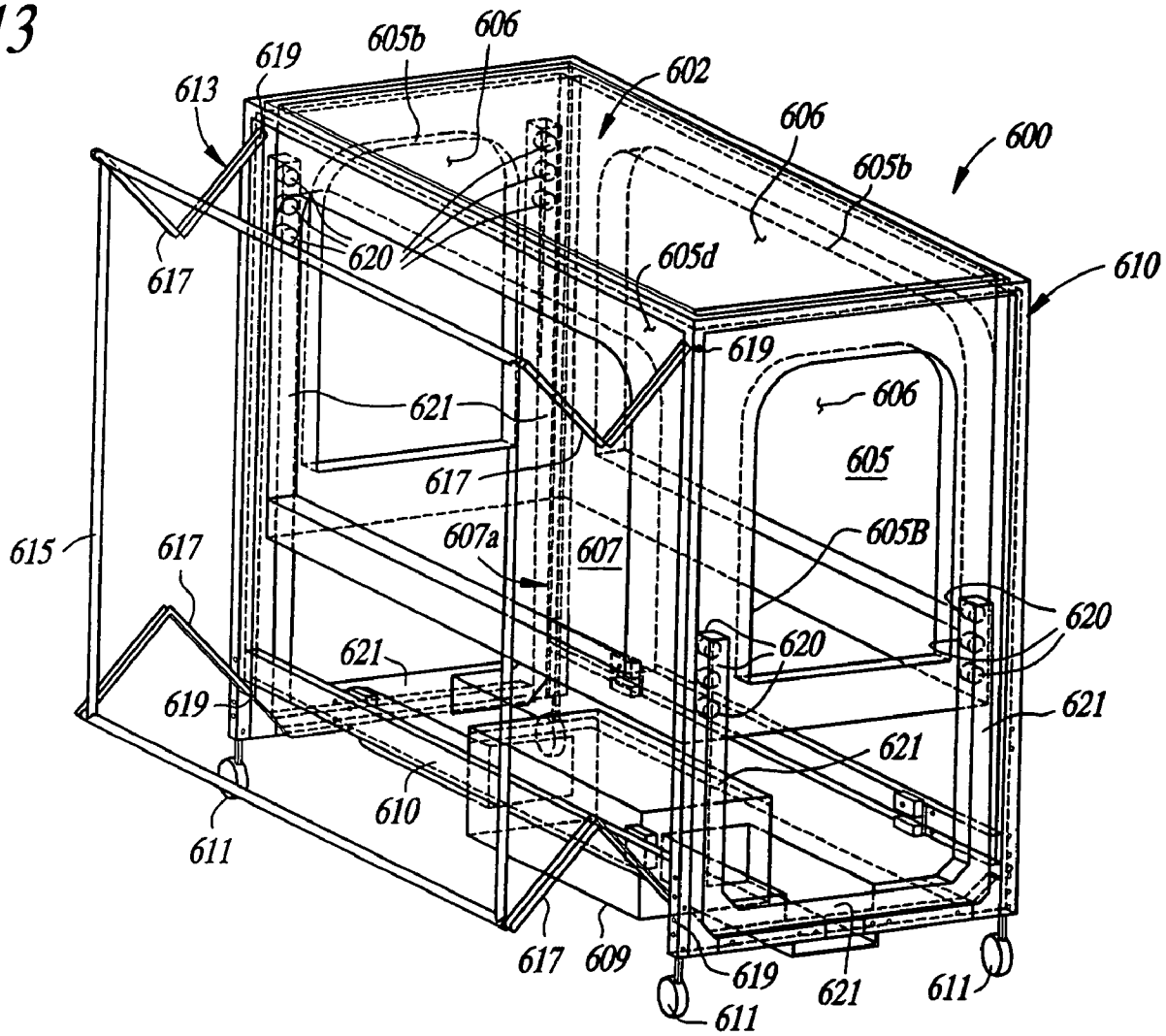
FIG. 13 is perspective view of another embodiment of an enclosure of the present invention that is particularly suited for use as a quarantine enclosure or as a patient isolation unit including a detachable, telescoping airlock.

In FIG. 10, another embodiment of an enclosure of the present invention is indicated generally by the reference numeral 400, and in FIGS. 11 and 12, another embodiment of an enclosure of the present invention is indicated generally by the reference numeral 500. The enclosures 400 and 500 are similar in many respects to the enclosure 100 described above, and therefore like reference numerals preceded by the numeral "4" or the numeral "5", instead of the numeral "1", are used to indicate like elements. As described further below, the enclosures 400 and 500 are particularly suited for use as quarantine enclosures and/or as patient isolation units.

With reference to FIG. 10, the enclosure 400 includes a canopy 402 mounted on a frame 410 (shown somewhat schematically in broken lines). The illustrated frame 410 may be the same as the collapsible frame 110 described above. The canopy 402 may be mounted to the frame 410 in the same manner as is the canopy described above (i.e., by sleeves releasably connected to the frame supports), and when so mounted, the canopy and frame define at least one isolation chamber 405 for enclosing and confining a patient to a predefined area. One difference between the canopy 402 and the canopies 102 or 302 described above, however, is that the canopy 402 defines an isolation chamber 405 that is sealed with respect to the exterior of the canopy to quarantine or isolate the patient located within the canopy, as described further below. As can be seen, the canopy 402 defines a plurality of glove ports 402*a* to allow a physician, other care giver or individual access to the patient and/or isolation chamber 405 of the canopy, and a plurality of transparent or otherwise see-through windows 406 to allow visibility therethrough. The quarantine canopy 402 may be made of any of numerous different materials that are currently known, or that later become known for effecting a safe and effective isolation of patients with any of a variety of infectious diseases or other conditions requiring quarantining or isolation, such as vinyl or other polymeric materials. An environmental control unit 409 is mounted on the exterior of the canopy 402 and coupled in fluid communication with the interior chamber 405 to control the flow of air into and out of the chamber and to otherwise control the environmental conditions within the chamber. The quarantine canopy 402 is provided with one or more quick disconnect couplings 402*b* for the administration of IV lines and/or the like from outside the quarantine canopy 402. In addition, the quarantine canopy 402 includes one or more ports or air locks 402*c* extending through an exterior wall thereof for the passage of food, medicine, waste and/or other matter therethrough. Such ports may take the form of any of numerous different sterile transfer ports or like devices that are currently known, or that later become known for performing the function of the ports 402*c*. Such sterile transfer ports also include a UV device or other means for sterilizing any matter removed from the isolation chamber therethrough to prevent contamination outside of the chamber. Such sterilizing means may take the form of any of numerous such means that are currently known, or that later become known for performing this function.

With reference to FIGS. 11 and 12, the enclosure 500 differs from the enclosure 400 in that the canopy 502 further defines an airlock chamber 507 formed within the canopy and adjacent to the isolation chamber 505, but separable therefrom. Alternatively, the airlock may be attachable to a side wall of the frame and canopy as described further below in order to convert the enclosure to include an airlock or vice versa. In this embodiment, the frame 510 is at least laterally larger than the frame 410 to laterally accommodate the airlock chamber 507 adjacent to the isolation chamber 505 as illustrated.

As shown in FIG. 11, the isolation chamber 505 is preferably positioned above a patient's bed 503 so that the patient is optimally positioned for effective care and/or observation. The frame 510 and the quarantine canopy 502 preferably cooperate to allow the patient's bed 503, which may be adjustably raised and/or lowered, to be easily removed and/or replaced as needed. In the illustrated embodiment, the mattress 501 of the bed is located beneath, and outside of the isolation chamber 505 such that at least one lower wall 505*a* of the isolation chamber 505 rests on the mattress 501 when the patient's bed is in place. In an alternative embodiment, the mattress 501 may be located within the isolation chamber 505 above the patient's bed 503 with at least one lower wall 505*a* of the isolation chamber 505 located between the mattress 501 and the other portions of the bed 503. One advantage of the illustrated embodiment is that the mattress and bed are isolated from the interior of the isolation chamber, thus preventing contamination of the mattress and bed, or preventing the need to sterilize or otherwise clean the mattress and bed between usages. Another advantage of the illustrated embodiment is that the frame can include means for transporting the frame, such as wheels, casters, bearings, sliders, or other devices that are currently known or that later become known for performing this function. Accordingly, the frame and canopy can be transported with the bed, and thus with a patient located within the isolation enclosure and supported by the bed. As a result, the isolation enclosure of the invention can avoid the need to remove the patient from the enclosure in order to transport the patient and/or the need to decontaminate the location of the enclosure after moving the enclosure, as encountered in prior art isolation enclosures.

The isolation chamber 505 also is provided with one or more transparent portions 506 both enabling effective observation of a quarantined patient and enabling the patient to see through to the exterior of the enclosure. The transparent portions 506 may be either clear or tinted as desired and, as with the rest of the isolation chamber 505, are preferably hermetically sealed and airtight.

The isolation chamber 505 is further provided with one or more access panels 505*b* suitable to allow direct access to a quarantined patient as needed. These access panels 505*b* may be selectively opened and/or hermetically closed as needed. Also, the access panels may be provided with decontamination means, such as, for example, an ultra-violet (UV) source or a disinfecting gas source (not shown). In addition, the access panels may be transparent, semi-transparent, may include a dark-colored mesh overlay, layer or other mesh portion to prevent glare when looking through such panels, may be opaque, or any desired combination of the foregoing.

The isolation chamber 505 also includes one or more access glove ports 505*c*, best shown in FIG. 11, to facilitate indirect interaction with the quarantined patient. The access glove ports 505*c* may be formed through the access panels 505*b*, as shown, or otherwise may extend through an exterior wall defining the isolation chamber 505. The access glove ports 505*c* also may be provided with suitable decontamination means as appropriate for different applications.

The airlock chamber 507 extends laterally adjacent to the isolation chamber 505 and extends the full length (or width) of the frame. The airlock chamber 507 may be provided with one or more ingress/egress openings 507*a*. The ingress/egress openings 507*a* preferably allow access to the airlock chamber 507. The ingress/egress openings 507*a* of the airlock chamber 507, similar to the access panels 505*b* of the isolation chamber 505, may be selectively opened and/or hermetically closed as needed, and may include decontamination means (not shown) to enable a person to safely enter and/or exit the airlock chamber 507. The airlock chamber 507 may be provided with one or more windows 507*b*, which may be substantially similar to the transparent portions 506 of the isolation chamber 505. The airlock chamber 507 is preferably located adjacent to the isolation chamber 505 and separated therefrom by at least one partition or side wall 505*d* that extends vertically between the upper and lower portions of the frame. In the illustrated embodiment, both the airlock chamber 507 and isolation chamber 505 are formed integral with each other within the canopy 502 and are supported by a common frame 510. The canopy 502 may be mounted on the frame 510 in the same manner as the canopy 102 described above (i.e., by sleeves releasably connected to the upper supports of the frame). In addition, the frame 510 may be the same as the frame 110 described above, or may be a different type of frame, such as a non-collapsible frame or a frame with telescoping supports for adjusting the size of the enclosure. In addition, as may be recognized by those of ordinary skill in the pertinent art based on the teachings herein, the airlock chamber 507 may be separably connected to the isolation chamber 505 and/or may have a separate frame (not shown) associated therewith that may be separably connected to the frame 510.

In accordance with one aspect of the present embodiment, the windows 507*b*, the access panels 505*b*, the ingress/egress openings 507*a*, and/or the transparent portions 506 each may have one or more layers associated therewith. For example, each of the foregoing features of the present embodiment may be provided with at least one opaque layer, at least one tinted layer, and/or at least one clear layer. This multi-layered arrangement could, for instance, be utilized to control the degree of visibility into the chamber and/or the amount of ambient light that is allowed into the chamber. Further, one or more of the windows may include a dark-colored mesh layer as described above in connection with the canopies 102 and 302 so that the other layer(s) can be removed or folded downwardly to thereby leave only the mesh layer within the window. In this case, the canopy would be used as a restraining enclosure, but not as a quarantine enclosure. Alternatively, the mesh layer may be used with the transparent or semi-transparent layer(s) to prevent glare as described above.

The environmental control system 509 preferably includes at least one air pump, a HEPA or other suitable filtration system, and one or more air-ingress and air-egress ports connected in fluid communication with the isolation chamber 505 and airlock chamber 507. The environmental control system 509 is preferably portably compact and relatively lightweight for easy mobility. The environmental control system 509 may be selectively operatively connected to the isolation chamber 505 and/or to the airlock chamber 507. If desired, the environmental control system 509 may be secured to the frame 510 so as to establish an efficient, effectively self-contained portable quarantine unit suitable for a variety of different quarantine or isolation applications. Preferably, as indicated above, the frame includes means for transporting the enclosure, such as wheels, casters, bearings, sliders, or other devices that are currently known or that later become known for performing this function. Accordingly, the frame and canopy can be transported with the bed, and thus with a patient located within the isolation enclosure and supported by the bed. Also, the environmental control system 509 preferably includes a battery back up in order to allow the system to operate during transportation of a patient within the enclosure from one location to another.

Figure 14:
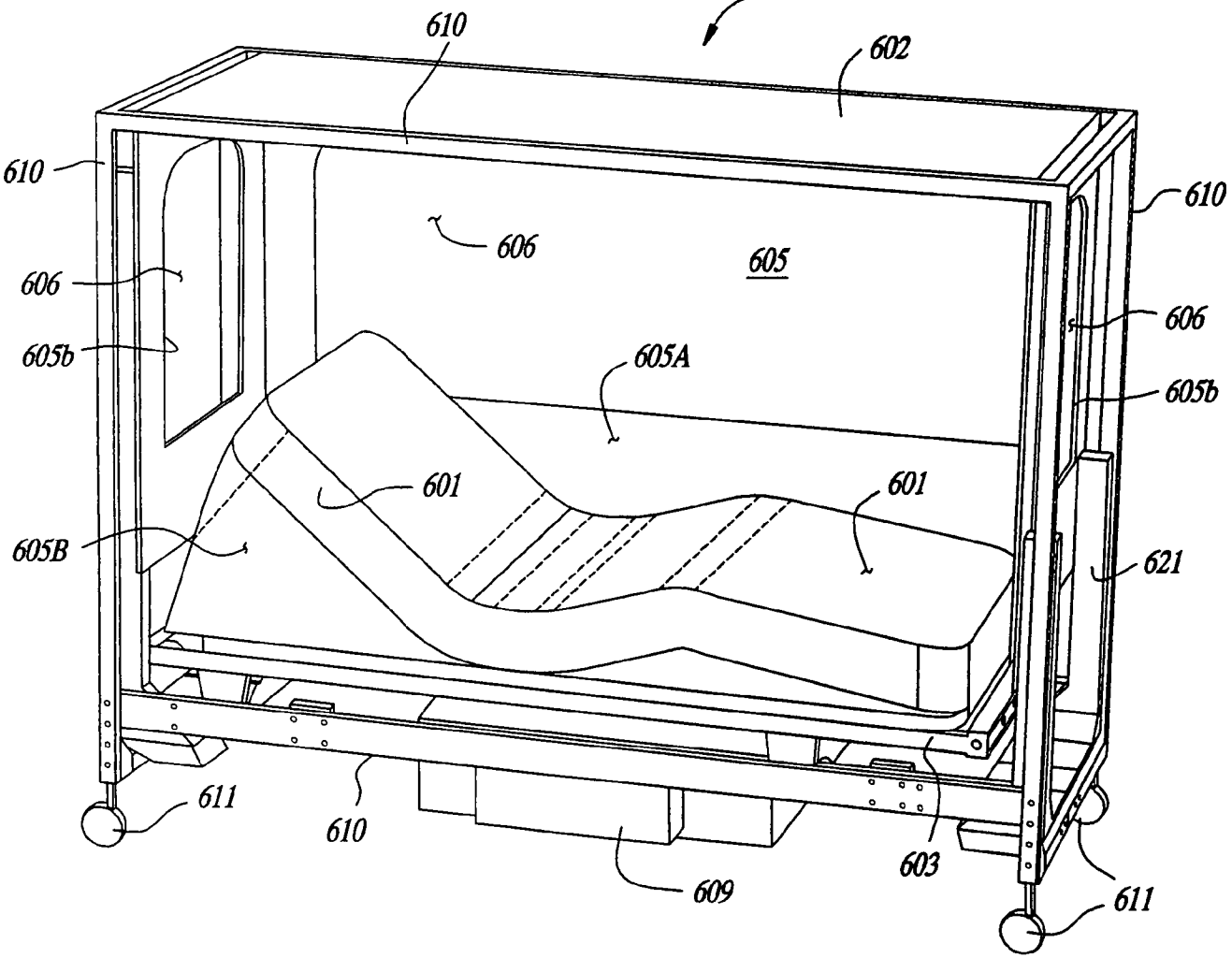
FIG. 14 is perspective view of the enclosure of FIG. 13 with the airlock and other parts removed for clarity and the head portion of the bed in an upwardly inclined position.
Figure 15:
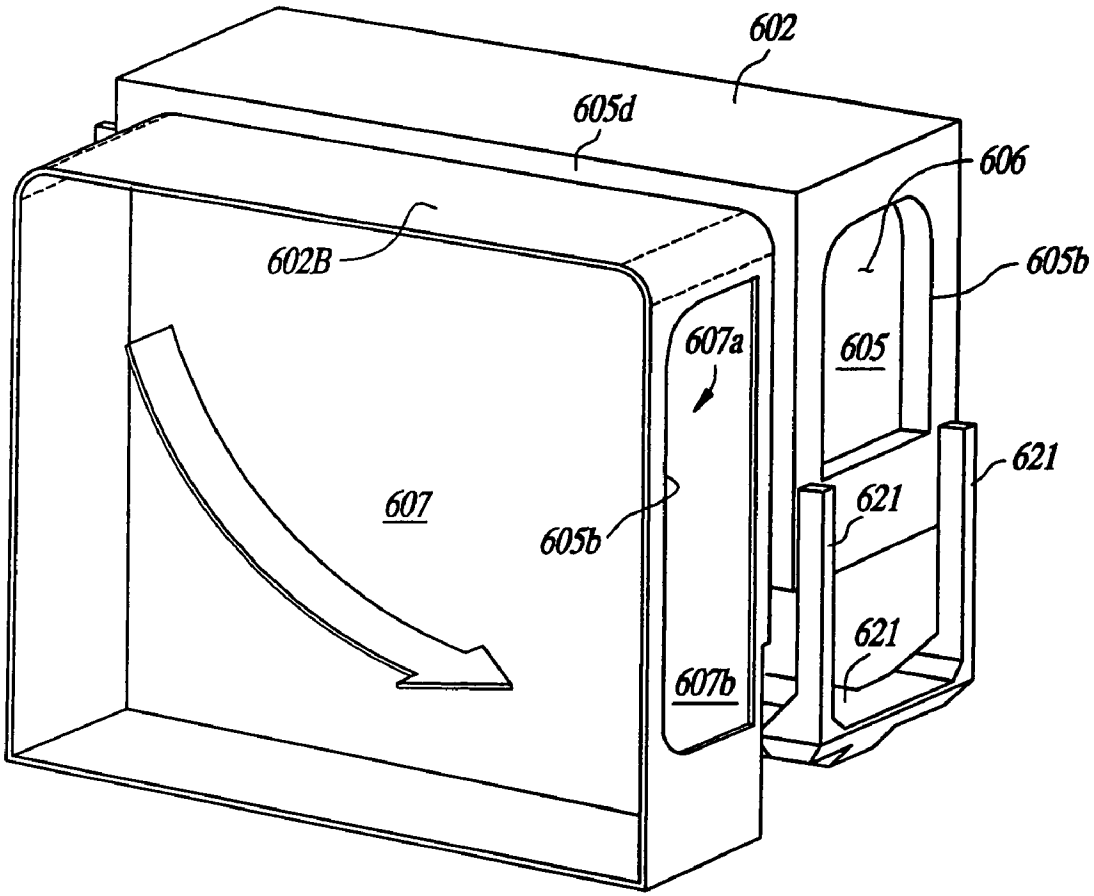
FIG. 15 is diagrammatic view of the isolation chamber and airlock chamber of FIG. 13 depicting airflow.

Turning now to FIGS. 13 through 17, another enclosure embodying the present invention is indicated generally by the reference numeral 600. The enclosure 600 is similar to the enclosures 400 and 500 described above, and therefore like reference numerals preceded by the numeral "6" instead of the numerals "4" or "5", are used to indicate like elements. The enclosure 600 differs from the enclosure 500 in that the airlock chamber 607 is located adjacent to the isolation chamber 605, but is separable therefrom and is stowable. Although the illustrated frame 610 is not collapsible as described above, it may be collapsible if desired. In addition, the frame 610 includes wheels or casters 615 for transporting the frame and canopy during use or otherwise. A separate airlock frame 611 is connectable to, and telescopes laterally relative to the frame 610 in order to accommodate the airlock chamber 607 adjacent to the isolation chamber 605. As can be seen, the airlock frame 611 includes a side wall portion 615 and laterally-extending, pivoting supports 617. As can be seen, the side wall portion 615 includes two horizontally extending supports and two vertically extending supports forming a rectangular or square configuration, and the laterally-extending supports 617 each are pivotally connected on one end to the side wall portion 615, and are pivotally connected on the other end to a respective vertically-extending support of the frame 610. The laterally-extending supports 617 are releasably connected by pins or other suitable fasteners 619 to the respective vertically-extending supports of the frame 610. As shown in FIG. 15, a separate airlock canopy 602B is connectable to the airlock frame 613 (shown in FIG. 13) in the same manner that the canopy 602 is connected to the frame 610, such as by hanging the canopy with sleeves to the upper horizontally extending supports of the respective frame, as described above. The airlock canopy 602B is connected and sealed to the canopy 602 such as by zippers, Velcro™ fasteners, or any of numerous other mechanisms for releasably connecting the airlock canopy to the main canopy and forming a substantially gas-tight seal therebetween.

As shown in FIGS. 14 and 15, the isolation chamber 605, like the isolation chamber 505, is preferably positioned above a patient's bed 603 so that the patient is optimally positioned for effective care and/or observation. The frame 610 and the isolation canopy 602 preferably cooperate to allow the patient's bed 603, which may be adjustably raised and/or lowered, to be easily removed and/or replaced as needed. As can be seen, the mattress 601 of the bed may be located beneath and outside of the isolation chamber 605 such that at least one lower wall 605*a* of the isolation chamber 605 rests on the mattress 601 when the bed 603 is in place. Alternatively, the mattress 601 may be located within the isolation chamber 605 above the bed 603 with at least one lower wall 605*a* of the isolation chamber 605 located between the mattress 601 and the other portions of the bed 603. Accordingly, one advantage of the enclosure of the present invention is that the mattress 601 and the bed 603 including its frame, motors, lifting structure and the like may be isolated from the interior of the isolation chamber 605, thus preventing contamination of the mattress and bed, and avoiding the need to decontaminate or otherwise clean the mattress and bed between usages. It will be appreciated that the bed 603 includes motors, gearing, greased drives and the like, decontamination of which would be inordinately difficult, if not impossible. As can be seen in FIG. 14, the bottom wall 605A of the canopy 602 includes an expanded portion 605B that includes sufficient material (or is sufficiently large) to allow the head portion of the bed (or other underlying portion of the bed if desired) to be moved up and down or otherwise as desired. As shown in FIG. 14, the expanded portion 605B preferably defines an upper portion that overlies, and substantially conforms to the upper surface of the mattress (or undersurface of the mattress if the mattress is located on top of the bottom wall 605A of the canopy), and three side wall portions extending between the base of the canopy and the upper surface of the expanded portion. The side wall portions may be pleated, define folds, or otherwise may be configured to allow the upper surface of the expanded portion to move with the bed when raising and lowering the bed, while maintaining a gas-tight seal between the isolation chamber 605 and the ambient atmosphere. In addition, if necessary to allow the head of the bed to be moved into the fully upright position, the bottom wall 605A is preferably configured to elevate itself at the outer limits of upward bed movement. The mounting of the canopy by sleeves to the frame as described above is particularly advantageous with respect to allowing this to occur.

The isolation chamber 605 also is provided with one or more transparent portions 606 both enabling effective observation of an isolated patient and enabling the patient to see through to the exterior of the enclosure. The transparent portions 606 may be either clear or tinted as desired and, as with the rest of the isolation chamber 605, are preferably hermetically sealed and airtight. Accordingly, the canopy 602 is sealed unto itself, thus defining an isolation chamber 605 for receiving a patient that is sealed with respect to the ambient atmosphere, and is self-contained (i.e., the sealed enclosure is defined entirely by the canopy and is not defined by, for example, the floor or other external surface). Because the canopy 602 is preferably mounted to the frame 610 with detachable sleeves, as described above, the canopy can be removed from the frame between usages with relative ease and decontaminated in any of numerous ways that are currently known, or that later become known. If desired, the canopy may be disposable, such that it is disposed of after each use, or the canopy may include a sealed liner or liner(s) that form the interior surfaces of the canopy, are sealed with respect to the canopy and the ambient atmosphere, and that can be removed from the canopy, disposed of, and replaced with a fresh liner or liners (that can be pre-sterilized if desired) between usages.

The isolation chamber 605 is further provided with one or more access panels 605*b* suitable to allow direct access to a patient as needed. These access panels 605*b* may be selectively opened and/or hermetically closed as needed. Also, the access panels may be provided with decontamination means, such as, for example, an ultra-violet (UV) source or a disinfecting gas source (not shown). In addition, the access panels may be transparent, semi-transparent, may include a dark-colored mesh overlay, layer or other mesh portion to prevent glare when looking through such panels, may be opaque, or any desired combination of the foregoing.

The isolation chamber 605 also may include one or more access glove ports as depicted for the isolation chamber 505, as shown in FIG. 11, to facilitate indirect interaction with the quarantined or isolated patient.

The airlock chamber 607 extends laterally adjacent to the isolation chamber 605 and extends substantially the full length (or width) of the frame 610. The airlock chamber 607 may be provided with one or more ingress/egress openings, access panels, windows, partitions or side walls, and the like similar to that of the isolation chamber 505. The canopy 602 may be mounted on the frame 610 in the same manner as the canopy 102 described above (e.g., by sleeves releasably connected to the upper supports of the frame 610). In addition, the frame 610 may be the same as the frame 110 described above, or may be a different type of frame, such as a non-collapsible frame or a frame with telescoping supports for adjusting the size of the enclosure. In the illustrated embodiment, the frame 610 also supports the bed 603 and environmental control system 609 and related ducts (i.e., the bed frame and canopy frame are integrated into a single frame). As with the isolation chamber, the environmental control device 609 is adapted to create in the airlock chamber 607 substantially the same or similar pressure conditions as in the isolation chamber 605, i.e., either a predetermined increase in pressure in comparison to the ambient atmosphere or a predetermined decrease in pressure in comparison to the ambient atmosphere.

Figure 16:
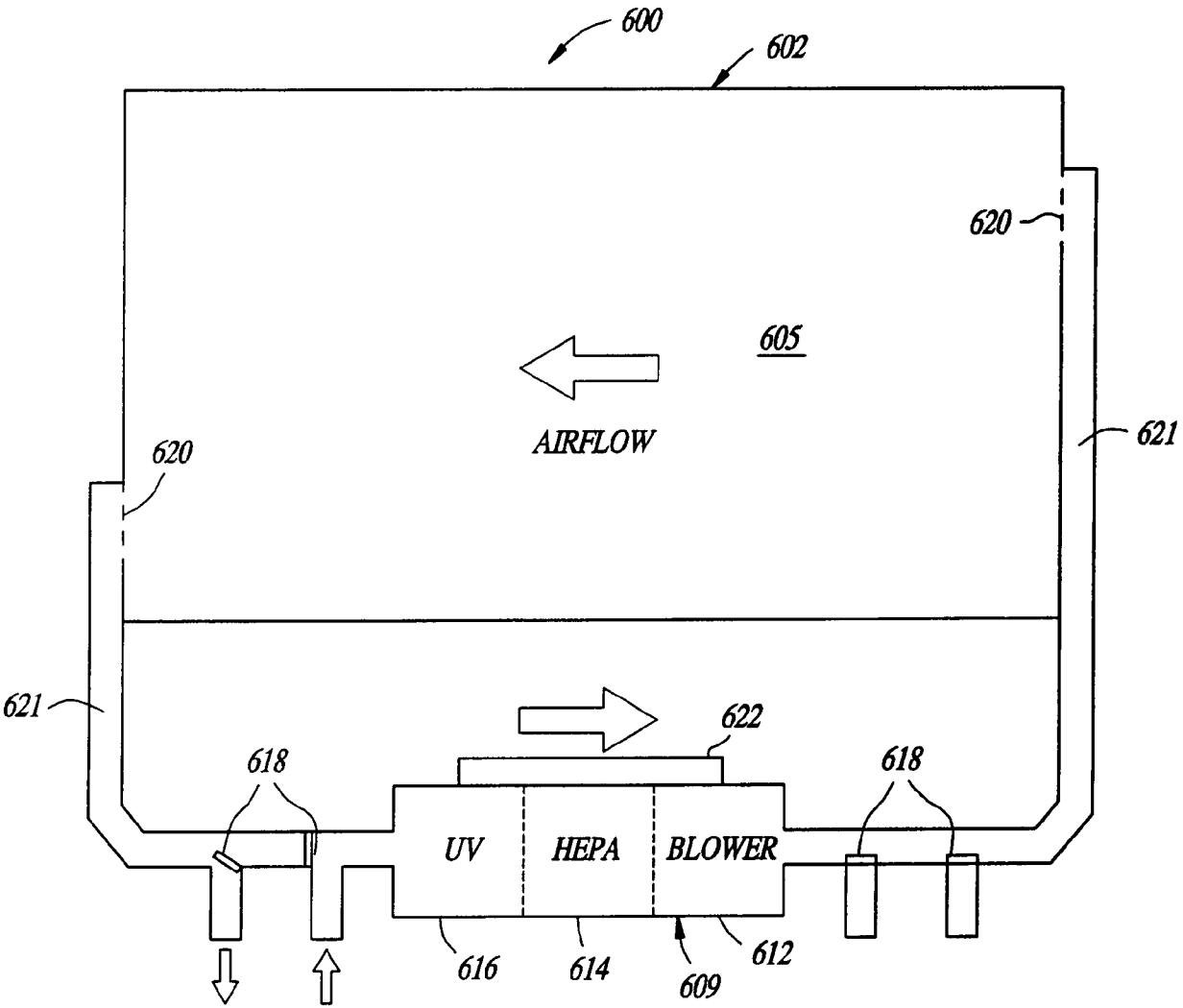
FIG. 16 is diagrammatic view of the environmental control system and airflow for the isolation chamber of FIG. 13 for positive pressure operation.
Figure 17:
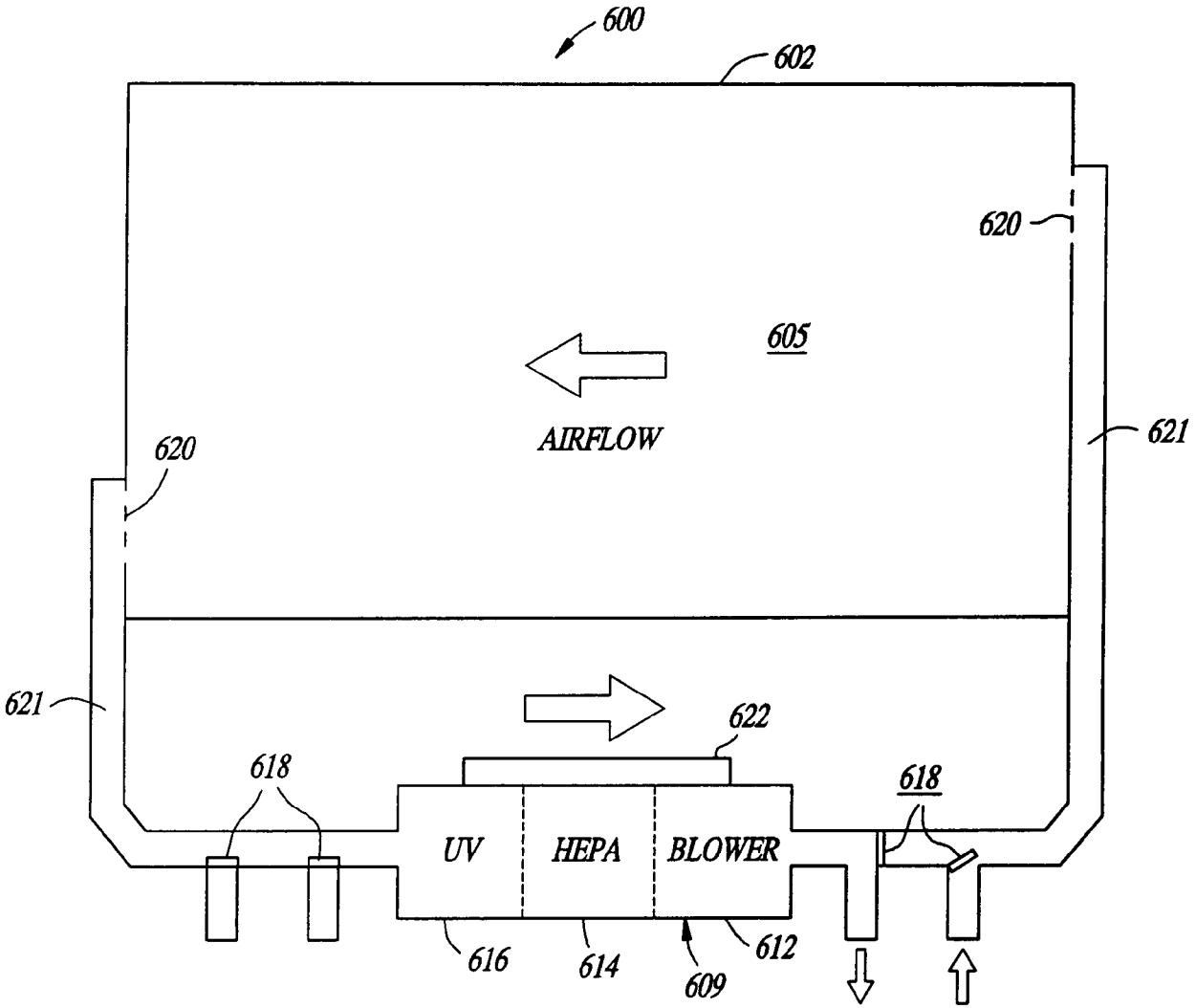
FIG. 17 is diagrammatic view of the environmental control system and airflow for the isolation chamber of FIG. 13 for negative pressure operation.

Referring to FIGS. 16 and 17, the environmental control system 609 preferably includes at least one air pump 612, a HEPA or other suitable filtration system 614, an optional decontamination means 616, such as an ultra-violet (UV) source or a disinfecting gas source (not shown), one or more flow directing dampers or valves 618, and one or more air-ingress and/or air-egress ports 620 connected through ducts 621 in fluid communication with the isolation chamber 605 and connectable in fluid communication with the airlock chamber 607. The environmental control system 609 is selectively configured by manipulation of the dampers or valves 618 for either patient isolation/quarantine or patient protection, thereby maintaining a negative pressure environment or a positive pressure environment relative to ambient, respectively. As can be seen, the ducts 621 are substantially U-shaped at the head-end and foot-end of the isolation chamber. In the illustrated embodiment, the ingress/egress ports at the head-end are located vertically higher than at the foot-end to allow for the head-end of the bed to be raised and lowered without interfering with airflow. However, as may be recognized by those of ordinary skill in the pertinent art based on the teachings herein, the ducting and/or port configuration may be changed as desired or otherwise required. The environmental control system 609 is preferably portably compact and relatively lightweight for easy mobility. Preferably, the environmental control system 609 includes a battery back-up power supply 622 to facilitate operation during movement or transportation, or power outages. The environmental control system 609 may be selectively operatively connected to the isolation chamber 605 and/or to the airlock chamber 607. Preferably, but not necessarily, the environmental control system 609 may be secured to the frame 610 so as to establish an efficient, effectively self-contained portable quarantine unit suitable for a variety of different quarantine applications.

In the operation of the airlock chamber 607, the physician or other caregiver or attendant steps into the chamber 607 when the chamber is at atmospheric pressure and not connected in fluid communication with the isolation chamber 605. Once located within airlock chamber the physician then closes the respective access door 605*b* in the airlock canopy 602*b*, seals the airlock with respect to the ambient atmosphere, and activates the environmental control device 609 to set the pressure within the airlock chamber to be substantially the same as that within the isolation chamber. When the pressures are substantially equal (the airlock and isolation chambers include pressure sensors of a type known to those of ordinary skill in the pertinent art), the environmental control unit indicates audibly and/or visually that the isolation chamber may be opened to the airlock. The physician then may open the access port to the isolation chamber and attend to the patient supported on the bed within the isolation chamber. When finished attending to the patient, the physician closes the isolation chamber, and activates the environmental control device to evacuate the airlock chamber 607 and sterilize the evacuated air by filtration and/or UV radiation prior to exhausting the air into an ambient atmosphere.

One advantage of the currently preferred embodiment of the present invention is that the airlock frame and canopy may be attached only when needed, and thus the isolation enclosure can be relatively easily and rapidly converted from including an airlock to not including an airlock, or vice versa. Note that the term "airlock" as used herein is intended to contemplate either or both a positive pressure airlock chamber and a negative pressure airlock chamber. Another advantage of the currently preferred embodiments of the present invention is that the isolation enclosure can be easily and rapidly converted (i.e., by switching the valves 618) from a high pressure isolation chamber (i.e., a chamber intended to protect the patient located within the chamber from the ambient atmosphere, such as a patient with a compromised immune system), to a low pressure chamber (i.e., a chamber intended to quarantine the patient and protect the ambient atmosphere and/or the people within the ambient atmosphere from the patient (such as for a patient with an airborne and/or communicable disease)).

Another advantage of the currently preferred embodiments of the present invention is that the enclosures are dimensioned to fit through doorways and hallways, such as conventional doorways and hallways encountered in hospitals. Thus, the enclosures are uniquely configured to transport an isolated patient throughout the different locations within, for example, a hospital, without having to remove the patient from the isolation chamber. In one embodiment of the present invention, the battery back-up includes a microprocessor to monitor the amount of battery power remaining and to generate data indicative of the amount of battery power remaining, including an audible and/or visible alarm when the remaining batter power falls below a predetermined level (e.g., about 10 to 20 minutes of remaining power at then current power usage levels). Also, if the battery power does fall to zero, and the system is not plugged into a power outlet, or the battery is not replaced with a fresh one, the dampers/valves preferably are configured to automatically open in order to allow air to flow into the isolation chamber and thereby prevent harm to a patient located within the chamber. In addition, the enclosure may include any of numerous different types of sensors that are currently known or that later become known for monitoring and/or controlling the conditions within the isolation chamber and airlock chamber, including pressure sensors, humidity sensors and/or temperature sensors with appropriate feedback control for regulating the pressure, humidity and/or temperature within each chamber as desired. In addition, the enclosure may include chemical sensors, such as CO and/or CO2 sensors, and visible and/or audible alarms for generating an alarm signal if the sensed elements fall outside of a desired range and, if necessary, and if necessary appropriate feedback control to adjust the flow of air into or out of the chambers based thereon. The enclosure also may include any of numerous additional features for either protecting the patient within the isolation chamber, and/or to protect the persons outside of the chamber. For example, when the patient is first put into the isolation chamber, the environmental control system will require the user to confirm the internal pressure setting (i.e., high pressure or low pressure) in order ensure that the system is correctly operated both to protect the patient and the caregivers or other persons outside of the enclosure.

As would be appreciated by those of ordinary skill in the pertinent art upon review of the subject disclosure, the figures and associated detailed description are representative of preferred embodiments and various modifications can be made thereto. While the invention has been described with respect to preferred embodiments, those skilled in the art will readily appreciate that various changes and/or modifications can be made to the invention without departing from the spirit or scope of the invention as disclosed herein and as claimed.

What is claimed is:

1. An isolation enclosure for isolating a person to an area about a bed, wherein the bed is adapted to support the person and includes a frame and a mattress overlying the frame, comprising:

a frame adapted to surround the bed and support a canopy that overhangs the bed;

a canopy connectable to the frame and defining an isolation chamber sealed with respect to the ambient atmosphere, the isolation chamber extends over the frame of the bed and is sufficiently sized to allow a person located within the isolation chamber to be supported on the bed and to move freely within the isolation chamber, wherein the canopy includes a base wall adapted to at least one of (i) overly the mattress of the bed, and (ii) lie between the mattress and the frame of the bed, the base wall defining an expanded portion that overlies a movable portion of the bed, and is movable with the movable portion of the bed to allow a person supported on the bed and within the isolation chamber to adjust the position of the bed;

a frame transport device mounted on the frame and adapted to transport the frame and canopy in cooperation with the bed to thereby transport a patient supported on the bed and located within the isolation chamber; and an environmental control device connectable in fluid communication with the isolation chamber and including (i) a filter adapted to at least one of filter air entering and filter air exiting the isolation chamber, and (ii) a pump adapted to at least one of pump air into the isolation chamber to increase the pressure within the isolation chamber relative to the ambient atmosphere, and pump air out of the isolation chamber to decrease the pressure within the isolation chamber relative to the ambient atmosphere.

2. An isolation enclosure as defined in claim 1, wherein the frame includes an upper laterally extending support, a first upstanding support coupled to a first side of the upper laterally extending support, and a second upstanding support coupled to a second side of the upper laterally extending support.

3. An isolation enclosure as defined in claim 2, wherein the canopy further includes at least one support portion for supporting the canopy on the upper laterally extending support.

4. An isolation enclosure as defined in claim 3, wherein at least one support portion is in the form of a mounting sleeve.

5. An isolation enclosure as defined in claim 3, wherein the canopy further includes at least one collar for mounting the canopy to at least one of the first and second upstanding supports.

6. An isolation enclosure as defined in claim 1, wherein the canopy further includes at least one access portion movable between a closed position and an open position defining an opening through the canopy for allowing access to the isolation chamber, and at least one see-through portion for permitting visual monitoring of the isolation chamber from outside of the canopy.

7. An isolation enclosure as defined in claim 1, wherein the environmental control device includes at least one battery for operating the device during transport of a person within the isolation chamber.

8. An isolation enclosure as defined in claim 1, wherein the environmental control device includes at least one valve adapted to selectively control the direction of flow of pumped air to either (i) pump air into the isolation chamber to increase the pressure within the isolation chamber relative to the ambient atmosphere, or (ii) pump air out of the isolation chamber to decrease the pressure within the isolation chamber relative to the ambient atmosphere.

9. An isolation enclosure as defined in claim 1, further comprising: at least one foldable and collapsible airlock chamber releasably connectable to the frame.

10. An isolation as defined in claim 9, wherein the airlock chamber is in fluid communication with the isolation chamber and the environmental control device.

11. An isolation enclosure as defined in claim 1, wherein the canopy includes at least one of: one or more access ports, one or more access panels, one or more windows, and one or more ingress/egress openings to facilitate sterile access to the isolation chamber.

12. An isolation enclosure as defined in claim 1, wherein the canopy includes one or more quick disconnect couplings for administering to the biological needs of a person located within the isolation chamber.

13. An isolation enclosure as defined in claim 1, wherein the environmental control device includes a UV source for sterilizing at least one of air entering the isolation chamber and air exiting the isolation chamber.

14. An isolation enclosure as defined in claim 1, wherein the expanded portion includes an upper portion that substantially conforms to at least one of an upper portion of the mattress and a lower portion of the mattress, and three side wall portions extending downwardly from respective sides of the upper portion, wherein the side wall portions define at least one of a fold and a pleat to allow the upper portion to move generally vertically with the bed.

15. An isolation enclosure as defined in claim 1, wherein the frame supports the bed, the canopy and the environmental control device.

16. An isolation enclosure as defined in claim 1, wherein the enclosure is immediately transportable with the bed and maintains the patient in an isolated condition with respect to the ambient surroundings throughout transport.

17. An isolation enclosure as defined in claim 1, wherein:

(i) the canopy is attached to the interior of the frame;

(ii) the frame further includes a plurality of upstanding supports; and (iii) the canopy further includes at least one collar for mounting the canopy to at least one of the upstanding supports, the at least one collar is attached to at least one portion of the canopy to secure the at least one portion of the canopy to at least one of the upstanding supports, while allowing portions of the canopy not secured to the at least one upstanding support to move at all angles in conjunction with the movable portion of the bed.

18. An isolation enclosure as defined in claim 17, wherein the portions of the canopy not secured to the at least one upstanding support define at least one of a fold and a pleat.

19. An isolation enclosure as defined in claim 1, wherein portions of the canopy define at least one of a fold and a pleat to allow said portions to move at all angles in conjunction with the movable portion of the bed.

20. An isolation enclosure for isolating a person to an area about a bed, wherein the bed is adapted to support the person and includes a frame and a mattress overlying the frame, comprising:

first means for forming an isolation chamber sealed with respect to the ambient atmosphere, wherein the isolation chamber extends over the frame of the bed and is sufficiently large to allow a person located within the isolation chamber to be supported on the bed and to move freely within the isolation chamber, wherein the first means includes second means forming a base portion of the isolation chamber for at least one of (i) overlying the mattress of the bed, and (ii) lying between the mattress and the frame of the bed, the second means defining third means movable with a movable portion of the bed for allowing a person supported on the bed and within the isolation chamber to adjust the position of the bed;

fourth means for supporting the first means and adapted to surround the bed;

fifth means mounted on the third means for transporting the first and second means in cooperation with the bed to thereby transport a patient supported on the bed and located within the isolation chamber; and sixth means connectable in fluid communication with the isolation chamber for at least one of (i) filtering at least one of air entering and air exiting the isolation chamber, and (ii) pumping at least one of air into the isolation chamber to increase the pressure within the isolation chamber relative to the ambient atmosphere, and pumping air out of the isolation chamber to decrease the pressure within the isolation chamber relative to the ambient atmosphere.

21. An isolation enclosure as defined in claim 20, wherein the first means is a canopy, the second means is a base wall of the canopy, the third means is an expandable portion of the base wall, the fourth means is a frame, the fifth means is a frame transport device, and the sixth means is an environmental control device connectable in fluid communication with the isolation chamber and including (i) a filter adapted to at least one of filter air entering and filter air exiting the isolation chamber, and (ii) a pump adapted to at least one of pump air into the isolation chamber to increase the pressure within the isolation chamber relative to the ambient atmosphere, and pump air out of the isolation chamber to decrease the pressure within the isolation chamber relative to the ambient atmosphere.

22. An isolation enclosure for isolating a person to an area about a bed, wherein the bed is adapted to support the person and includes a frame and a mattress overlying the frame, comprising:

a frame adapted to surround the bed and support a canopy that overhangs the bed;

a canopy connectable to the interior of the frame and defining an isolation chamber sealed with respect to the ambient atmosphere, wherein the isolation chamber extends over the frame of the bed and is sufficiently large to allow a person located within the isolation chamber to be supported on the bed and to move freely within the isolation chamber, wherein the canopy includes a base wall adapted to at least one of (i) overly the mattress of the bed, and (ii) lie between the mattress and the frame of the bed and at least one device for mounting the canopy to the frame, the at least one device is attached to at least one portion of the canopy to secure the at least one portion of the canopy to the frame, while allowing portions of the canopy not secured to the frame to move at all angles in conjunction with a movable portion of the bed;

a frame transport device mounted on the frame and adapted to transport the frame and canopy in cooperation with the bed to thereby transport a patient supported on the bed and located within the isolation chamber;

an environmental control device connectable in fluid communication with the isolation chamber and including (i) a filter adapted to at least one of filter air entering and filter air exiting the isolation chamber, and (ii) a pump adapted to at least one of pump air into the isolation chamber to increase the pressure within the isolation chamber relative to the ambient atmosphere, and pump air out of the isolation chamber to decrease the pressure within the isolation chamber relative to the ambient atmosphere; and at least one foldable and collapsible airlock chamber including an airlock frame and an airlock canopy releasably connectable to the frame and in fluid communication with at least one of the isolation chamber and the environmental control device, wherein at least a portion of the airlock canopy is movable at all angles in conjunction with the movable portion of the bed.

23. An isolation enclosure as defined in claim 22, wherein the enclosure is immediately transportable with the bed and maintains the patient in an isolated condition with respect to the ambient surroundings throughout transport.

* * * * *